US012742450B2

(12) United States Patent
Hoefel et al.

(10) Patent No.: US 12,742,450 B2
(45) Date of Patent: Sep. 22, 2026

(54) MOTOR POWER OPTIMIZATION FOR DOWNHOLE MOTORS

(71) Applicant: Sensia Netherlands B.V., Rotterdam (NL)

(72) Inventors: Albert Hoefel, Sugar Land, TX (US); Jonathan Wun Shiung Chong, Calgary (CA); Dwayne Robert Kelly, Edmonton (CA); Jeffery Anderson, Beaumont (CA); Derek David Meier, Katy, TX (US); Norman Andrew Weatherhead, Kitchener (CA)

(73) Assignee: Schlumberger Technology Corporation, Sugar Land, TX (US)

( * ) Notice: Subject to any disclaimer, the term of this patent is extended or adjusted under 35 U.S.C. 154(b) by 5 days.

(21) Appl. No.: 18/736,141

(22) Filed: Jun. 6, 2024

(65) Prior Publication Data

US 2025/0376979 A1 Dec. 11, 2025

(51) Int. Cl.

| | |
|---|---|
| ***F04B 49/06*** | (2006.01) |
| ***E21B 43/12*** | (2006.01) |
| ***F04B 47/06*** | (2006.01) |
| ***F04B 49/20*** | (2006.01) |
| ***F04D 13/08*** | (2006.01) |

(52) U.S. Cl.

CPC ..... *F04B 49/065* (2013.01); *F04B 47/06* (2013.01); *F04B 49/20* (2013.01); *F04D 13/086* (2013.01); *E21B 43/128* (2013.01); *F04B 2203/0201* (2013.01); *F04B 2203/0202* (2013.01); *F04B 2203/0204* (2013.01); *F04B 2203/0209* (2013.01); *F04B 2205/07* (2013.01); *F04B 2205/09* (2013.01)

(58) Field of Classification Search

CPC .... F04B 49/065; F04B 49/20; H02P 2203/09; H02P 23/14

See application file for complete search history.

(56) References Cited

U.S. PATENT DOCUMENTS

| | | | | |
|---|---|---|---|---|
| 2012/0265190 | A1 | 10/2012 | Curley et al. | |
| 2015/0167466 | A1 | 6/2015 | Teodorescu et al. | |
| 2017/0002641 | A1 | 1/2017 | Dykstra et al. | |
| 2017/0045055 | A1* | 2/2017 | Hoefel | H02K 5/132 |
| 2017/0058653 | A1 | 3/2017 | Gupta et al. | |

(Continued)

FOREIGN PATENT DOCUMENTS

| | | | |
|---|---|---|---|
| CN | 106068458 | A | 11/2016 |
| EP | 4 026 984 | A1 | 7/2022 |
| EP | 4 206 437 | A1 | 7/2023 |

OTHER PUBLICATIONS

EP Search Report on Appl. No. 24214098.6 dated Apr. 29, 2025.

(Continued)

*Primary Examiner* — Kenneth J Hansen

(74) *Attorney, Agent, or Firm* — FOLEY & LARDNER LLP

(57) ABSTRACT

Systems and methods provided herein relate to optimization of the motor of a pump system. Voltage-frequency ratios are adjusted while maintaining pumps speed in a systematic manner to lower power usage. Oscillations of the motor speed are detected, and voltage-frequency ratios adjusted to maintain low levels of oscillations while lowering power usage. Savings resulting in the optimization of the pump system are estimated.

20 Claims, 11 Drawing Sheets

(56) References Cited

U.S. PATENT DOCUMENTS

| | | | | |
|---|---|---|---|---|
| 2017/0089192 | A1 | 3/2017 | Rendusara et al. | |
| 2018/0087359 | A1 | 3/2018 | Conn et al. | |
| 2018/0209252 | A1 | 7/2018 | Shanks et al. | |
| 2020/0132882 | A1 | 4/2020 | Runkana et al. | |
| 2020/0355189 | A1 | 11/2020 | Hoefel et al. | |
| 2022/0018231 | A1 | 1/2022 | Weatherhead et al. | |
| 2022/0154889 | A1 | 5/2022 | Otto | |
| 2022/0170353 | A1 | 6/2022 | Chong et al. | |
| 2022/0180019 | A1 | 6/2022 | Chong et al. | |
| 2023/0184071 | A1* | 6/2023 | Janger | F04D 15/0066 417/423.3 |
| 2023/0361645 | A1 | 11/2023 | Selvaraj et al. | |

OTHER PUBLICATIONS

International Preliminary Report on Patentability on Appl. No. PCT/US2024/032945 dated Sep. 4, 2025.

International Search and Written Opinion of the International Searching Report on Appl. No. PCT/US2025/032423 dated Sep. 17, 2025.

Alighanbari et al., "Deep Reinforcement Learning With NMPC Assistance Nash Switching for Urban Autonomous Driving," 2022, IEEE Transactions On Intelligent Vehicles, vol. 8, Issue 3, pp. 1-12.

Hoon, O., "Q-MPC: stable and efficient reinforcement learning using model predictive control," 2023, IFAC PapersOnLine, vol. 56, Issue 2, pp. 2727-2732.

International Search Report and Written Opinion on PCT/US2024/032945 dated Sep. 24, 2024.

Jones et al., "Characterising the Digital Twin: A systematic literature review," CIRP Journal of Manufacturing Science and Technology, May 2020, vol. 29, Part A, (pp. 36-52).

Maddox et al., "Fast Adaptation with Linearized Neural Networks," Proceedings of the 24th International Conference on Artificial Intelligence and Statistics (AISTATS) 2021, San Diego, California, USA. PMLR: vol. 130. Copyright 2021 by the author(s)(11 pages).

O,Neill, "How Zoox robotaxi predicts everything, everywhere, all at once," Amazon.science, Aug. 9, 2022 https://www.amazon.science/latest-news/how-the-zoox-robotaxi-predicts-everything-everywhere-all-at-once [procure from the internet Jun. 13, 2024] (10 pages).

Srouji et al., "Safe Real-World Reinforcement Learning for Mobile Agent Obstacle Avoidance," Apple Machine Learning Research, Oct. 2022 (7 pages).

Grubmuller et al., "A Digital Isolated High Voltage Probe for Measurements in Power Electronics," 2018, IEEE 27th International Symposium on Industrial Electronics (ISIE), Cairns, QLD, Australia, pp. 791-796, doi: 10.1109/ ISIE.2018.8433652.

Sealevel, "What is optical isolation and Why is it beneficial?" 2023, Sealevel Systems Inc., 3 pages.

* cited by examiner

MOTOR POWER OPTIMIZATION FOR DOWNHOLE MOTORS

CROSS-REFERENCE TO RELATED PATENT APPLICATIONS

This application is related to U.S. patent application Ser. No. 18/517,986 filed on Nov. 22, 2023 and U.S. Provisional Patent Application No. 63/472,132 filed on Jun. 9, 2023, all of which are incorporated by reference herein in their entireties.

BACKGROUND

The present disclosure relates generally to monitoring and/or controlling equipment at a well site including but not limited to controls that reduce power usage of a well pump and/or downhole motor system.

Motors may be used to drive pumps and move fluid in a well in a subterranean environment. Pressure and flow of the pump may relate to torque and speed of the motor driving the pump. Pump pressure and flow and therefore motor torque and speed may be determined by the characteristics of the well and the desired hydrocarbon flow rate. Sensor disposition may be difficult in subsurface pumps and conventional systems may not optimize the characteristics of the electrical power driving the motor at the determined torque and speed.

SUMMARY

An embodiment of the present disclosure relates to a system for efficiently running a pump driven by a motor. The system includes a number of memory devices having instructions stored thereon that, when executed by a number of processors, cause the processors to perform operations including receiving a desired operating rotational speed of the motor. The operations include receiving motor electrical data related to current signals and voltage signals of a drive connected to the motor. The operations include calculating an estimated rotational speed of the motor using the motor electrical data. The operations include adjusting an operating voltage of the drive connected to the motor to obtain an adjusted operating voltage. The operations include adjusting an operating frequency of the drive to control the estimated rotational speed of the motor to the desired operating rotational speed in response to changes to the estimated rotational speed from adjustments to the operating voltage. The operations include monitoring an electrical power consumed by the drive resulting from the adjusted operating voltage and adjusting the operating frequency. The operations include performing additional adjustments to the operating voltage and the operating frequency in a systematic manner to affect the motor to operate at a higher efficiency while controlling the estimated rotational speed of the motor to the desired operating rotational speed.

In some embodiments adjusting the operating frequency is performed by a proportional-integral controller.

In some embodiments performing the additional adjustments includes adjusting a combined value equal to an uncompensated voltage divided by a current operating frequency and calculating the adjusted operating voltage by multiplying the combined value by the current operating frequency, wherein the adjusted operating voltage is based on the uncompensated voltage.

In some embodiments performing the additional adjustments includes using a gradient descent procedure, an extremum seeking control procedure, or a golden section search procedure.

In some embodiments the operations include estimating a cable voltage drop to obtain an estimated cable voltage drop, wherein the adjusted operating voltage is calculated by adding the estimated cable voltage drop to the uncompensated voltage.

In some embodiments the operations include calculating an asymmetric voltage to compensate for asymmetries in the cable voltage drop as the operating frequency and operating voltages are adjusted.

In some embodiments determining the desired operating rotational speed of the pump includes performing an optimization using an objective function including at least one of pump efficiency or pump vibration.

In some embodiments the operations include estimating a savings resulting from adjusting the operating voltage. Estimating the savings includes monitoring the electrical power consumed by the drive during a first time period prior to adjusting the operating voltage of the drive and during a second time period after adjusting the operating voltage. Estimating the savings includes comparing the electrical power consumed during the first time period to the electrical power consumed during the second time period.

An embodiment of the present disclosure relates to a system for efficiently running a pump driven by a motor. The system includes a number of memory devices having instructions stored thereon that, when executed by a number of processors, cause the processors to perform operations including receiving motor electrical data related to current signals and voltage signals of a drive connected to the motor. The operations include estimating oscillations of the motor speed or an angle between a current vector and a magnetic flux vector using the motor electrical data to obtain an estimated magnitude of the oscillations. The operations include increasing an operating voltage of the drive connected to the motor in response the estimated magnitude of the oscillations being greater than a threshold. The operations include decreasing the operating voltage down in response to the estimated magnitude of the oscillations being less than the threshold.

In some embodiments increasing and decreasing the operating voltage is performed by a proportional-integral controller configured to maintain the estimated magnitude of the oscillations at a setpoint.

In some embodiments estimating the oscillations includes using an electrical model of the motor to calculate an estimate of a rotational speed of the motor and determining a magnitude of oscillations in the estimate of the rotational speed.

In some embodiments estimating the oscillations includes calculating a magnitude of oscillations in phase currents within a frequency band.

In some embodiments the operations include determining an initial operating voltage base on an operating flow and operating pressure of the pump and a model of the motor.

In some embodiments the operations include determining a desired operating pressure and a desired operating flow of the pump by an optimization using an objective function includes at least one of pump efficiency or pump vibration.

In some embodiments the operations include determining the threshold, wherein the threshold is determined by estimating a magnitude of noise of data used to estimate the oscillations.

In some embodiments the operations include estimating a savings resulting from adjusting the operating voltage. Estimating the savings includes monitoring an electrical power consumed by the drive during a first time period prior to adjusting the operating voltage of the drive and during a second time period after adjusting the operating voltage. Estimating the savings includes comparing the electrical power consumed during the first time period to the electrical power consumed during the second time period.

An embodiment of the present disclosure relates to a method for efficiently running a motor-driven pump. The method includes calculating an estimated rotational speed of the motor using a motor electrical data. The method includes providing an operating voltage and an operating frequency of the motor in a systematic manner to either affect the motor to operate at a higher efficiency while controlling the estimated rotational speed of the motor to a desired operating rotational speed; or affect the motor such that an estimated magnitude of oscillations in the estimated rotational speed are driven towards a target value.

In some embodiments the desired operating rotational speed of the pump is determined by performing an optimization using an objective function including at least one of pump efficiency or pump vibration.

In some embodiments the method includes estimating a savings resulting from adjusting the operating voltage. Estimating the savings includes monitoring an electrical power consumed by the drive during a first time period prior to adjusting the operating voltage of the drive and during a second time period after adjusting the operating voltage. Estimating the savings includes comparing the electrical power consumed during the first time period to the electrical power consumed during the second time period.

In some embodiments providing the operating voltage and the operating frequency includes using proportional-integral controller.

DETAILED DESCRIPTION

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

The present disclosure relates to pump systems including, but not limited to, electric submersible pumps and progressive cavity pumps applied to pumping hydrocarbons from well reservoirs. Systems and methods are used to affect the motor to operate at a high or improved efficiency. While the systems and methods disclosed can be used for any motor system they are particularly advantageous related to downhole motors in the hydrocarbon industry where sensor disposition is more difficult. In some embodiments, systems and methods are used to calculate the energy savings after performing optimization.

Hydrocarbon Site Overview

Figure 1:
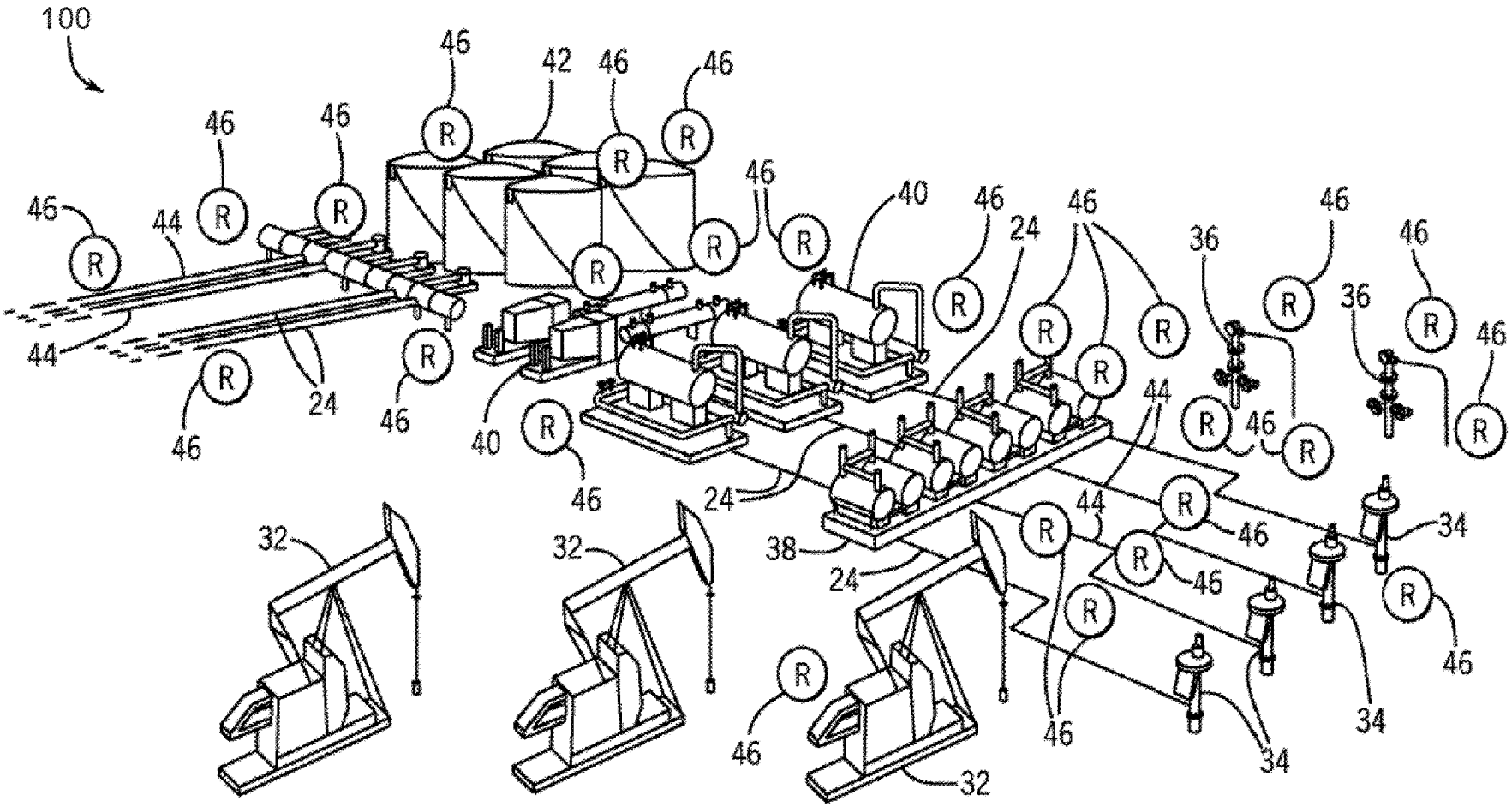
FIG. 1 is a perspective view of a hydrocarbon site equipped with well devices, according to some embodiments.

Referring now to FIG. 1, a hydrocarbon site 100 may be an area in which hydrocarbons, such as crude oil and natural gas, may be extracted from the ground, processed, and/or stored. As such, the hydrocarbon site 100 may include a number of wells and a number of well devices that may control the flow of hydrocarbons being extracted from the wells. In one embodiment, the well devices at the hydrocarbon site 100 may include any device equipped to monitor and/or control production of hydrocarbons at a well site. As such, the well devices may include pumpjacks 32, submersible pumps 34, well trees 36, and other devices for assisting the monitoring and flow of liquids or gasses, such as petroleum, natural gasses and other substances. After the hydrocarbons are extracted from the surface via the well devices, the extracted hydrocarbons may be distributed to other devices such as wellhead distribution manifolds 38, separators 40, storage tanks 42, and other devices for assisting the measuring, monitoring, separating, storage, and flow of liquids or gasses, such as petroleum, natural gasses and other substances. At the hydrocarbon site 100, the pumpjacks 32, submersible pumps 34, well trees 36, wellhead distribution manifolds 38, separators 40, and storage tanks 42 may be connected together via a network of pipelines 44. As such, hydrocarbons extracted from a reservoir may be transported to various locations at the hydrocarbon site 100 via the network of pipelines 44.

The pumpjack 32 may mechanically lift hydrocarbons (e.g., oil) out of a well when a bottom hole pressure of the well is not sufficient to extract the hydrocarbons to the surface. The submersible pump 34 may be an assembly that may be submerged in a hydrocarbon liquid that may be pumped. As such, the submersible pump 34 may include a hermetically sealed motor, such that liquids may not penetrate the seal into the motor. Further, the hermetically sealed motor may push hydrocarbons from underground areas or the reservoir to the surface.

The well trees 36 or christmas trees may be an assembly of valves, spools, and fittings used for natural flowing wells. As such, the well trees 36 may be used for an oil well, gas well, water injection well, water disposal well, gas injection well, condensate well, and the like. The wellhead distribution manifolds 38 may collect the hydrocarbons that may have been extracted by the pumpjacks 32, the submersible pumps 34, and the well trees 36, such that the collected hydrocarbons may be routed to various hydrocarbon processing or storage areas in the hydrocarbon site 100.

The separator 40 may include a pressure vessel that may separate well fluids produced from oil and gas wells into separate gas and liquid components. For example, the separator 40 may separate hydrocarbons extracted by the pumpjacks 32, the submersible pumps 34, or the well trees 36 into oil components, gas components, and water components. After the hydrocarbons have been separated, each separated component may be stored in a particular storage tank 42. The hydrocarbons stored in the storage tanks 42 may be transported via the pipelines 44 to transport vehicles, refineries, and the like.

The well devices may also include monitoring systems that may be placed at various locations in the hydrocarbon site 100 to monitor or provide information related to certain aspects of the hydrocarbon site 100. As such, the monitoring system may be a controller, a remote terminal unit (RTU), or any computing device that may include communication abilities, processing abilities, and the like. For discussion purposes, the monitoring system will be embodied as the RTU 46 throughout the present disclosure. However, it should be understood that the RTU 46 may be any component capable of monitoring and/or controlling various components at the hydrocarbon site 100. The RTU 46 may include sensors or may be coupled to various sensors that may monitor various properties associated with a component at the hydrocarbon site 10.

The RTU 46 may then analyze the various properties associated with the component and may control various operational parameters of the component. For example, the RTU 46 may measure a pressure or a differential pressure of a well or a component (e.g., storage tank 42) in the hydrocarbon site 100. The RTU 46 may also measure a temperature of contents stored inside a component in the hydrocarbon site 100, an amount of hydrocarbons being processed or extracted by components in the hydrocarbon site 100, and the like. The RTU 46 may also measure a level or amount of hydrocarbons stored in a component, such as the storage tank 42. In certain embodiments, the RTU 46 may be iSens-GP Pressure Transmitter, iSens-DP Differential Pressure Transmitter, iSens-MV Multivariable Transmitter, iSens-T2 Temperature Transmitter, iSens-L Level Transmitter, or Isens-10 Flexible I/O Transmitter manufactured by vMonitor® of Houston, Texas.

In one embodiment, the RTU 46 may include a sensor that may measure pressure, temperature, fill level, flow rates, and the like. The RTU 46 may also include a transmitter, such as a radio wave transmitter, that may transmit data acquired by the sensor via an antenna or the like. The sensor in the RTU 46 may be wireless sensors that may be capable of receive and sending data signals between RTUs 26. To power the sensors and the transmitters, the RTU 46 may include a battery or may be coupled to a continuous power supply. Since the RTU 46 may be installed in harsh outdoor and/or explosion-hazardous environments, the RTU 46 may be enclosed in an explosion-proof container that may meet certain standards established by the National Electrical Manufacturer Association (NEMA) and the like, such as a NEMA 4× container, a NEMA 7× container, and the like.

The RTU 46 may transmit data acquired by the sensor or data processed by a processor to other monitoring systems, a router device, a supervisory control and data acquisition (SCADA) device, or the like. As such, the RTU 46 may enable users to monitor various properties of various components in the hydrocarbon site 100 without being physically located near the corresponding components. The RTU 46 can be configured to communicate with the devices at the hydrocarbon site 100 as well as mobile computing devices via various networking protocols.

In operation, the RTU 46 may receive real-time or near real-time data associated with a well device. The data may include, for example, tubing head pressure, tubing head temperature, case head pressure, flowline pressure, wellhead pressure, wellhead temperature, and the like. In any case, the RTU 46 may analyze the real-time data with respect to static data that may be stored in a memory of the RTU 46. The static data may include a well depth, a tubing length, a tubing size, a choke size, a reservoir pressure, a bottom hole temperature, well test data, fluid properties of the hydrocarbons being extracted, and the like. The RTU 46 may also analyze the real-time data with respect to other data acquired by various types of instruments (e.g., water cut meter, multiphase meter) to determine an inflow performance relationship (IPR) curve, a desired operating point for the wellhead 30, key performance indicators (KPis) associated with the wellhead 30, wellhead performance summary reports, and the like. Although the RTU 46 may be capable of performing the above-referenced analyses, the RTU 46 may not be capable of performing the analyses in a timely manner. Moreover, by just relying on the processor capabilities of the RTU 46, the RTU 46 is limited in the amount and types of analyses that it may perform. Moreover, since the RTU 46 may be limited in size, the data storage abilities may also be limited.

In certain embodiments, the RTU 46 may establish a communication link with the cloud-based computing system 12 described above. As such, the cloud-based computing system 12 may use its larger processing capabilities to analyze data acquired by multiple RTUs 26. Moreover, the cloud-based computing system 12 may access historical data associated with the respective RTU 46, data associated with well devices associated with the respective RTU 46, data associated with the hydrocarbon site 100 associated with the respective RTU 46 and the like to further analyze the data acquired by the RTU 46. The cloud-based computing system 12 is in communication with the RTU via one or more servers or networks (e.g., the Internet).

In some embodiments, the best operating point of a submersible downhole pump may be determined by performing an optimization process. For example, model-based optimization or artificial intelligence may be used in order to determine an operating point (i.e., operating pressure, flow, and/or speed of the pump). In some embodiments, the optimization process may include determining the set of wells and the corresponding pump operating points in order to hit a certain production constraint while operating efficiently. In some embodiments, the best operating point may be transmitted to a motor optimization system.

Downhole Pump and Data Acquisition

The present disclosure relates to pump systems, including, but not limited to, downhole pump systems, reciprocating pump systems, such as sucker rod pump systems, submersible pump systems, electric motors on a well site and other electrical systems. In some embodiments, isolation is achieved for measuring and/or data acquisition devices. In some embodiments, the systems and methods avoid potentially destructive saturation effect on coupling transformers with direct current (DC) contents and/or high voltage to frequency (volts/hertz (V/Hz)) ratios. The systems and methods allow better assessment of developing cable or motor leakage to ground through the zero-sequence voltage for quantified symmetry to ground (e.g., earth) of the phase voltages.

In some embodiments, the systems and methods of isolation allow more types of measurements and more precise measurements with less cost and no saturation risk related to high V/Hz ratios or DC contents. An apparatus provides a cost-effective solution for proper high voltage insulation with no or little performance degradation on the analog acquisition.

Figure 2:
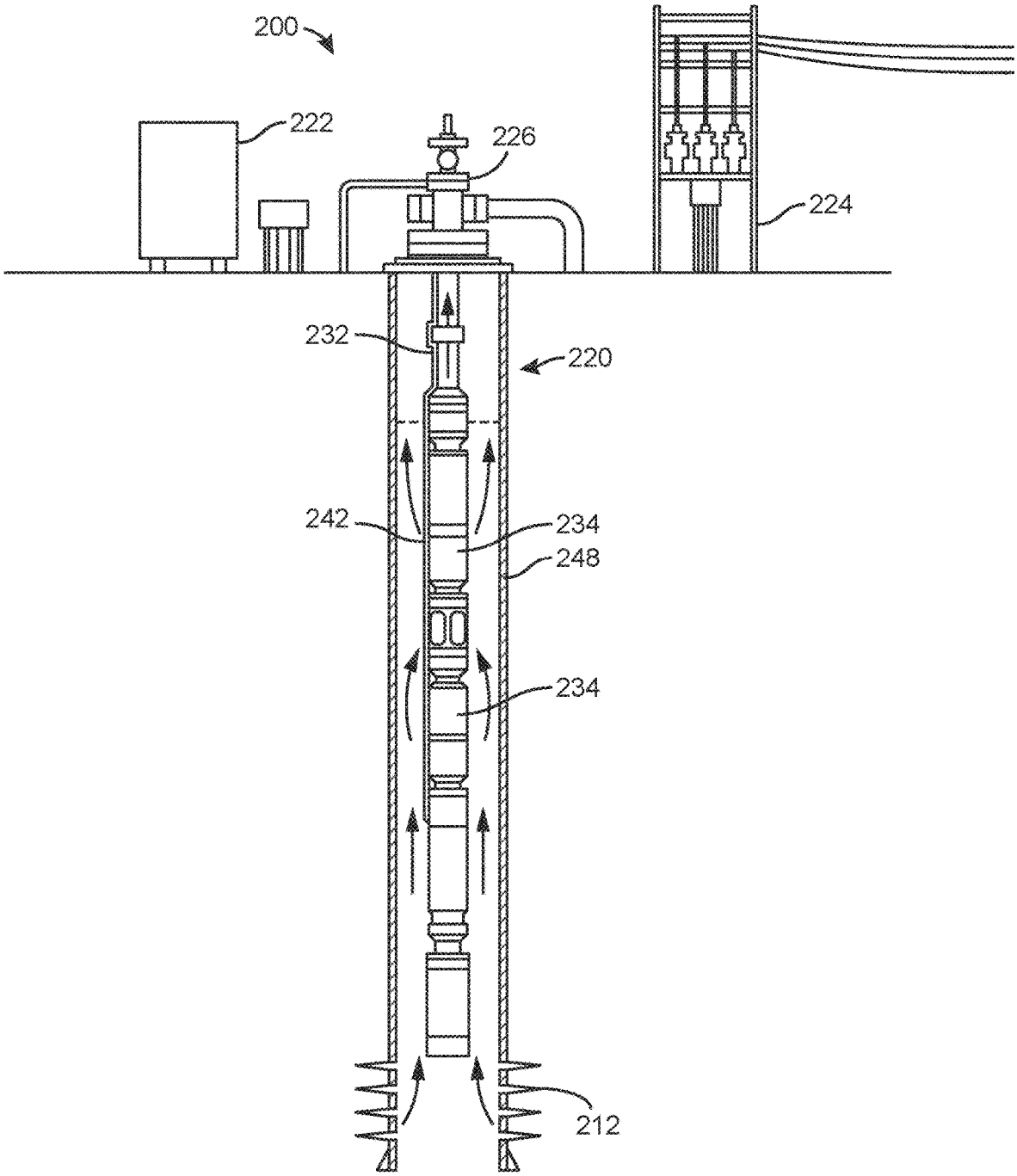
FIG. 2 is a schematic diagram of a well site that includes a pump, according to some embodiments.

With reference to FIG. 2, a well site 200 includes a pump 220, a controller 222, electrical transformers 224, and a well head 226. Produced fluids 212 are pumped by pump 220 to well head 226. Pump 220 can be one or more electrical submersible pumps (ESPs), each including an electric motor controlled by a variable speed drive in controller 222. The variable speed drive adjusts output of pump 220 by controlling the speed of the electric motor via signals to the armature, rotor/stator, or other winding of the motor. The motors are two pole, three phase induction motors in some embodiments. Controller 222 can also include a user interface or a computer to provide various settings for well site operations. Although shown as a subsurface pump, pump 220 can be any type of pump or motor system in some embodiments.

Electrical transformers 224 provide power (e.g., electric voltage and current for the variable speed drive). Controller 222 includes circuits and components that can protect components of well site 200 by shutting off power if normal operating limits are not maintained. Power cables 232 supply the electric signals to one or more motors through armor protected, insulated conductors. Power cables 232 are round except for a flat section along the one or more ESPS and motor protectors where space is limited in some embodiments. In some embodiments, the motor protectors connect pump 220 to motor and isolate the motor from produced fluids and other well fluids. The motor protectors serve as an oil reservoir and equalize pressure between the well bore and the well casing or tubing casing annulus 48 and allow expansion and/or contraction of motor oil in some embodiments.

Pump housing 234 for pump 220 includes multi-stage rotating impellers and stationary diffusers in some embodiments. The number of stages (e.g., centrifugal stages) is related to the rate, pressure and required power and can be any number from 1 to n depending on design criteria and well site parameters. Gas separators 242 can be employed to segregate some free gas from produced fluids into the tubing casing annulus 248 by fluid reversal or rotary centrifuge before gas enters pump 220. Intakes to pump 220 allow fluids to enter the pump 220 and may be part of a gas separator 242. In some embodiments, the well site 200 is for a cased well or an open well. For example, a partially cased well may include an open well portion or portions. An annular space may exist between an outer surface of tubing casing annulus 248 and the pump 220.

Figure 3:
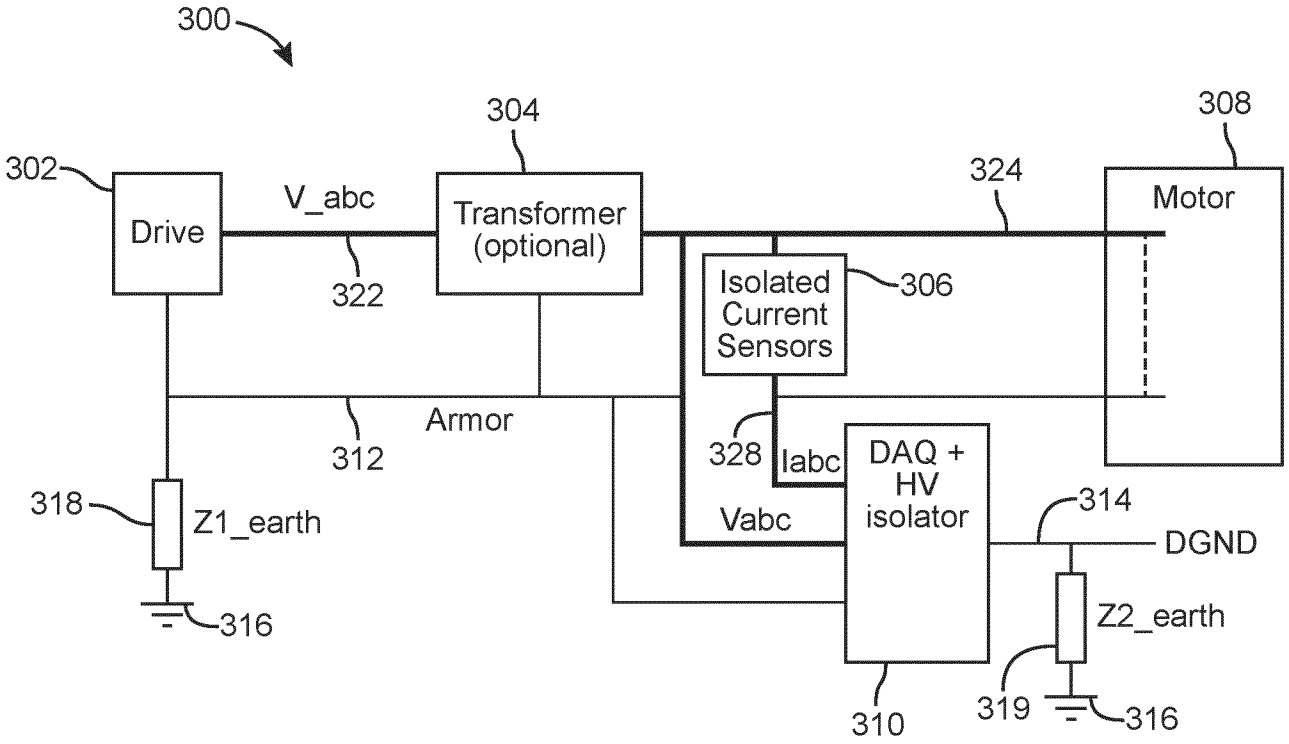
FIG. 3 is a schematic diagram of an isolated data acquisition system coupled to sensors, a motor, and a drive which can be used at the well site illustrated in FIG. 2, according to some embodiments.

With reference to FIG. 3, a system 300 can be part of well site 200 (FIG. 2) or any of the various pumping systems shown in hydrocarbon site 100. Although system 300 is particularly advantageous when used with subsurface motors for pumps where sensor disposition is more difficult, system 300 can be used with motors disposed above surface. System 300 can be employed at various petroleum processing systems, mines, industrial systems, etc. In some embodiments, system 300 is used with water pumps, geothermal power generation and heating, etc. Downhole pumps in water industry, waste industry, mine dewatering, geothermal plants, etc. can be used with system 300.

System 300 includes an electrical drive 302, a transformer 304, a current sensor system 306, a motor 308, and a data acquisition system 310. System 300 can be part of a lift system. System 300 is configured to provide isolation for electrical surface power measurements and perform condition monitoring in some embodiments. In some embodiments, system 300 provides analog signal acquisition (e.g., voltage and current measurement acquisition). System 300 can be part of a Powerdaq and/or HCC2 controller manufactured by Sensia LLC in some embodiments. The HCC2 controller can include analog acquisition hardware and software. In some embodiments, electrical drive 302 may be part of a controller (e.g., controller 222) and motor 308 may be part of a pumping system (e.g. pump 220).

Electrical drive 302 is any type of power source for powering components associated with system 300. Electrical drive 302 can be a high voltage drive. In some embodiments, drive 302 provides two or three phase alternating current (AC) power on a cable 322 (e.g., two or more conductor cable). Cable 322 can be coupled to motor 308 in some embodiments. An electric drive can refer to a system that utilizes electric power to propel machinery or control various mechanical/electrical processes. Electrical drive 302 can include power electronics, transformers, converters, energy storage, and control systems.

Electrical drive 302 is coupled to a transformer 304. Transformer 304 is optional. Transformer 304 can be a step up or step down transformer. Transformer 304 receives power from drive 302 and transforms the power to a different level on cable 324 which is coupled to motor 308. Cable 324 is similar to cable 322. The power from transformer 304 is three phase alternating current (AC) power in some embodiments. In some embodiments, without a transformer 304, cable 322 is coupled directly or indirectly to motor 308.

Cables 324 and 322 include a shield 312 that is coupled to an earth ground 316 (e.g., a structure coupled to earth, platform, chassis, etc.). An impedance 318 is between earth ground 316 and shield 312 (e.g., armor ground 313). An impedance 319 is between earth ground 316 and a conductor 314 which is coupled to digital ground or DGND 315 in some embodiments. Earth ground 316 is a contact point where conductors coupled to DGND 15 and cables connecting to armor ground 313 are connected in some embodiments. Impedances 318 and 319 generally represent a nominal impedance associated with connections to earth ground 316. Shield 312 isolated from conductor 314 in some embodiments.

Motor 308 is any type of electrical device. Motor 308 can be a solenoid, an inductive motor, an AC motor, a direct current motor, a linear motor, or other device for translating electrical energy into motion or force. In some embodiments, motor 308 is a two or three phase electrical motor. Motor 308 can receive signals with specific voltage levels, waveshapes, and frequencies depending on the system and application. In some embodiments, the voltage signals are sinusoidal signals at 208 volts, 230 volts, 460 volts, and/or 575 volts. The selection of the appropriate voltage depends on factors such as the power requirements of the motor, the type of driven machinery, and the overall electrical infrastructure. Lower voltage systems, such as 208V and 230V systems, are often suitable for smaller motors and applications with moderate power demands, while higher voltage levels like 460V and 575V are employed for larger motors.

Current sensor system 306 includes one or more sensors configured to sense current provided through cable 324 or cable 322. In some embodiments, current sensor system 306 includes three current isolation sensors for measuring currents $I_A$, $I_B$, and $I_C$ associated with motor 308 in some embodiments. The current isolation sensors are current transformer (CT) sensors that include a primary and a secondary to isolate signals in some embodiments. Other types of sensors can be utilized for current sensor system 306. Sensor signals indicative of the currents $I_A$, $I_B$, and $I_C$ are provided to data acquisition system 310, where currents $I_A$, $I_B$, and $I_C$ represent three phases of motor current in some embodiments.

Current isolation sensors refer to any device that provides signals related to measurements of frequency and/or amplitude with isolation in some embodiments. Current sensor system 306 measures and monitors current flow without direct electrical contact between the sensing element and the conductor carrying the current in some embodiments. The isolation can be achieved through various technologies such as magnetic coupling or optical isolation.

Data acquisition system 310 is configured to provide insulation or isolation for circuitry associated with capturing parameters in the environment of system 300. Data acquisition system 310 includes circuitry for providing isolation and circuitry for receiving and or processing measurements. The circuitry associated with digitally processing measurements uses voltages referenced to digital ground (DGND) 315 provided using conductor 314 some embodiments. Circuitry associated with receiving measurements uses voltages referenced to armor ground 313 in some embodiments. Data acquisition system 310 can include or be coupled to computing devices (e.g., an edge controller) for processing the measurements and providing analysis and control and can include or be coupled to communication devices for communicating with users, the cloud, networks, or other servers. Data acquisition system 310 can be a digital system powered by an isolated power supply in some embodiments.

In some embodiments, data acquisition system 310 is configured to monitor electrical surface power quality which can be an important task in oilfield applications. Measurements by data acquisition system 310 can be used to ascertain grid power quality and the integrity of the equipment. For example, the electrical load measurements associated with operations of motor 308 can provide valuable information of the overall system (e.g., the health and operational conditions of motors and pumps). Data acquisition system 310 provides high frequency (e.g., greater than 5 khz) acquisition of all motor phase voltages and currents. Generally, independent of the drive type of drive 302, the sensors need to withstand 5000 volt root mean square (Vrms) phase to phase voltage. Data acquisition system 310 provides acquisition on the high voltage side with digital isolation without sacrificing performance or reduction of scope in some embodiments.

Three phase voltage signals $V_A$, $V_B$, and $V_C$ represent three phases of voltage provided to motor 308 (e.g., three motor phases via cables 324 and/or 322) in some embodiments. In some embodiments, the measurements are floating relative to earth ground 316. The phase voltage relative to shield 312 (e.g., armor ground 313) is implicitly defined by the parasitic capacitances and leakage between phase voltage signals and shield 312. With symmetrical motor, cable and other optional equipment, the phase voltages are symmetrical to armor ground 313 associated with shield 312. The shield 312 acts as a shield or isolator and is on at the potential of armor ground 313. The potential of DGND 315 does not have to be completely isolated, and DGND 315 and armor ground 313 can share a reference point (e.g., earth ground 316) in some embodiments. Apart from negligible impedances 318 (e.g., Z1_earth) and 319 (Z2_earth), the digital isolated low voltage of the edge controller (referenced to DGND potential) associated with data acquisition system 310 and the drive or transformer housing (referenced to armor ground 313) are coupled to earth ground 316 in some embodiments. Isolation by data acquisition system 310 prevents a direct return current path from the high voltage phase voltage signals $V_A$, $V_B$, and $V_C$ through the conductor 314 (DGND 315) back to earth ground 316. A high voltage isolator circuit separate or part of data acquisition system 310 can provide the isolation.

Various sensors can be provided as part of system 200. The sensors can be connected to or part of data acquisition system 310 in some embodiments. Current, voltage, speed, torque, pressure, power, position, frequency, and load sensors can be provided in some embodiments. For example, position sensors can include an inclinometer, proximity switches (e.g., Hall Effect sensors), etc., and load sensors can include load cells, current sensors, and a beam transducer, etc. Such sensors can be operatively coupled to a controller (e.g., via wire and/or wirelessly through wireless circuitry). As an example, a load cell can be a load-capable dynamometer attached to the polished rod for acquiring dynamic data, which may be transmitted and/or otherwise accessed by one or more pieces of equipment. The controller can utilize sensor data to calculate rod loading (e.g., a surface condition) and, coupled with various models (e.g., algorithms), to estimate downhole pump fill (e.g., a downhole condition). Sensed parameters allow various conditions to be diagnosed including but not limited to gas interference, liquid fluid pound severity and gas interference, system leaks, stuck pumps, parted rods and various other anomalies or operating conditions using a dynamometer. The systems and methods described herein may provide an advantageous solution for providing isolation and increased accuracy of monitored variables for one-dimensional, two-dimensional and/or three-dimensional models of the Gibbs wave equation.

System 300 can implement one or more offline techniques and/or online or live techniques to control equipment at well site 200 in response to the monitored parameters. System 300 may be configured to estimate or predict values of variables that are relatively more difficult to measure such as gas content, intake pressure, motor speed, damping, and the like. It should be understood that these particular variables are presented as an example and should not be understood as limiting.

Motor Optimization

Figure 4:
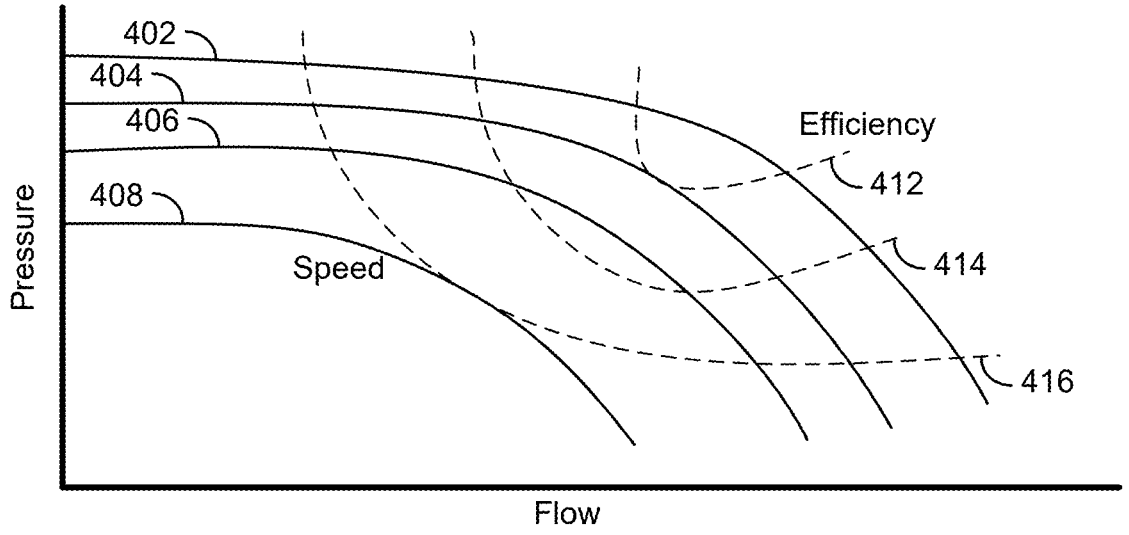
FIG. 4 is a plot of a pump speed curves and pump efficiency, according to some embodiments.

FIG. 4 shows a pump model in the form of several pump curves (e.g. pump curves 402-408) relating pump head pressure to pump flow at various speeds. The pump represented by pump model is shown to operate at various efficiencies (by isocurves of equal efficiency 412-416) depending on the operating point (pressure, flow, and/or speed) of the pump. By appropriate choice of the number of pumps and their respective operating point it is possible for the hydrocarbon site optimizer to maintain a production level while operating efficiently. Optimizing the motor operation may relate to finding an efficient electrical voltage and frequency with which to drive the motor while operating at the speed specified by the pump operating point.

Figure 5:
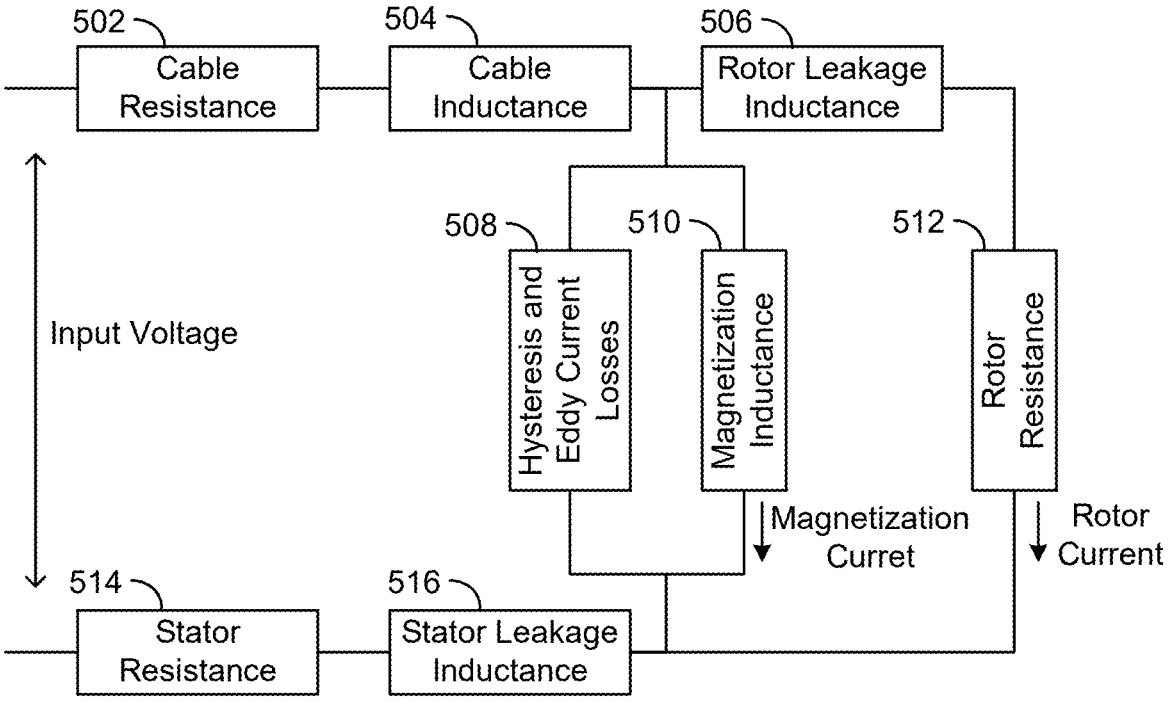
FIG. 5 is a schematic of a motor equivalent circuit model, according to some embodiments.
Figure 6:
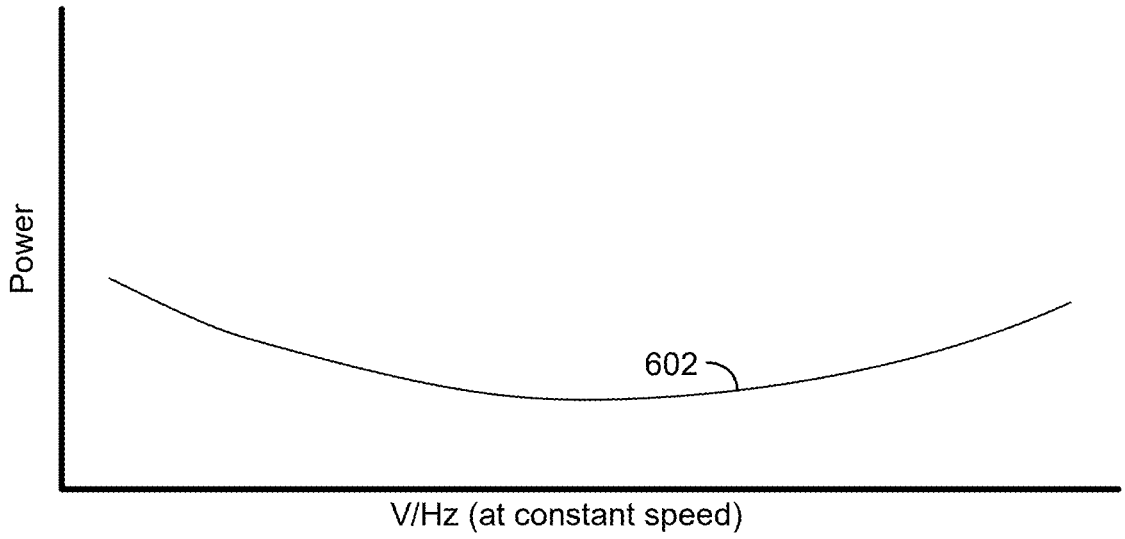
FIG. 6 is a plot of how power usage of a motor changes with applied voltage-frequency ratio while motor speed is maintained, according to some embodiments.

FIG. 5 shows an electrical equivalent circuit of an induction motor and the cable coupling the drive to the motor according to some embodiments. In some embodiments, the equivalent circuit includes cable resistance 502, cable inductance 504, rotor leakage inductance 506, hysteresis and eddy current losses 508, magnetization inductance 510, rotor resistance 512, stator resistance 514, and stator leakage inductance 516. In order to respond to different torque and speed requirements, based on the pressure and flow requirements of the pump, the motor drive may change the frequency and voltage at which the motor is driven. Accordingly, the operating best operating voltage and frequency may change with the pressure and flow requirements of the pump. FIG. 6 shows an example of a curve 602 created of power as the voltage-frequency ratio is input on the motor while keeping the motor at the constant speed required to operating at the desired pump operating point. In some embodiments, curve 602 is shown to indicate higher power usage for both low and high voltage-frequency ratios and a range of minimal power usage for intermediate values of the voltage-frequency ratio.

Some embodiments of the systems and methods described herein are related to adjusting the voltage and the frequency used to drive the motor that uses a minimal power. Advantageously, the systems and methods herein may not require values for the electrical equivalent circuit model of FIG. 5 and thus may not require the time, data, and/or expense required to fully characterize a motor and enter that information during commissioning of the pump system.

Figure 7:
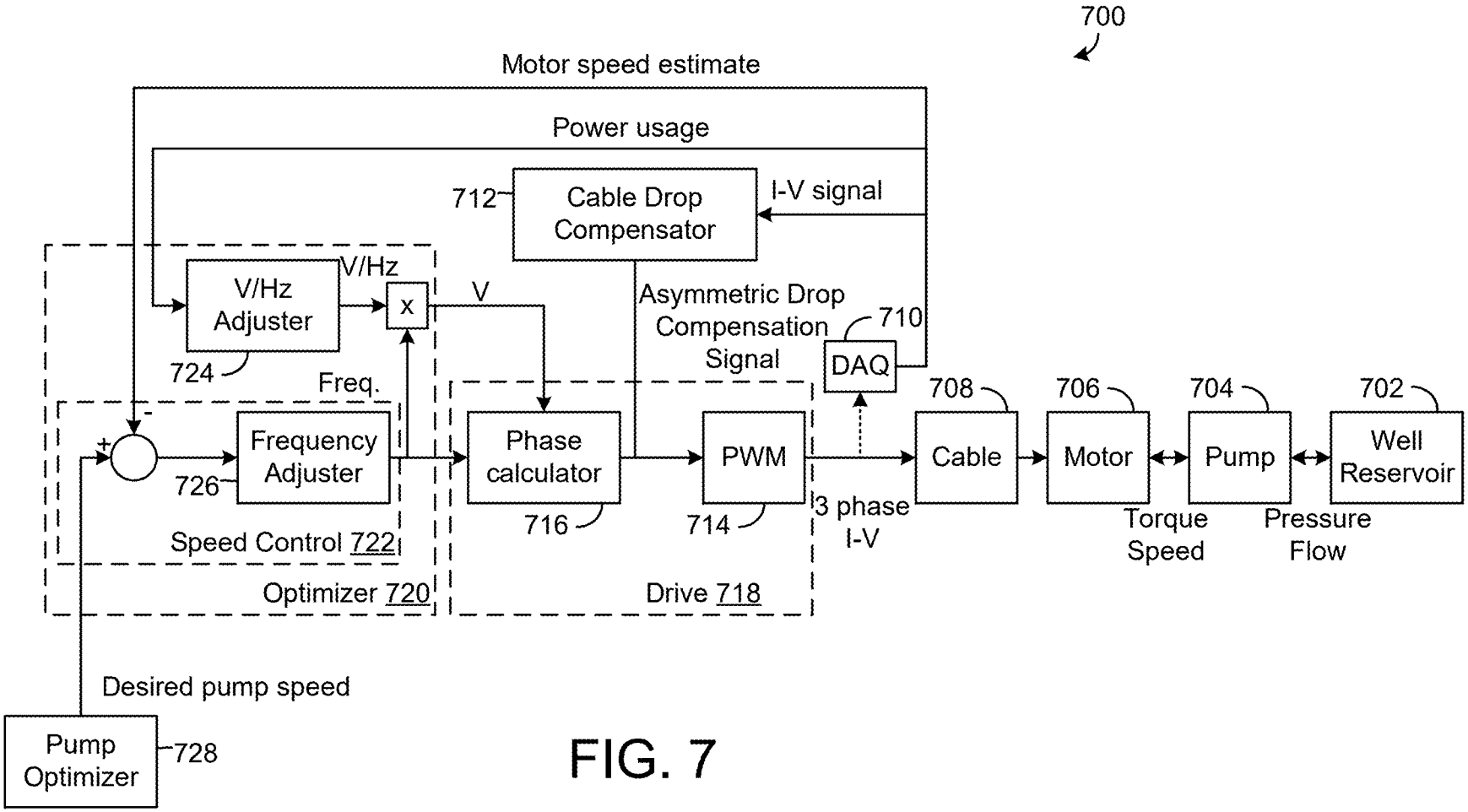
FIG. 7 is a signal flow diagram showing a strategy for optimizing the operating voltage and frequency of a motor, according to some embodiments.

FIG. 7 shows a signal flow diagram of a system for pumping hydrocarbons from a well according to some embodiments. According to some embodiments, well reservoir 702 may be a well site (e.g., well site 200) for which an operating flow may be chosen via an optimization routine in order to determine the best flow for well reservoir 702 across all the well reservoirs that make up the site (e.g., hydrocarbon site 10). In some embodiments, the operating flow of the well may be chosen using other techniques; for example, the flow may be chosen using pump rating information independently of how other well reservoirs are performing. In some embodiments, characteristics of the well reservoir may influence the pressure that forms across pump 704 (e.g., pump 220). For example, the depth of the well reservoir, the density of the fluid being pumped, and the viscosity of the fluid being pumped may all influence the pressure across 704 at various flow rates. In some embodiments, the desired pressure and flow of the pump may determine the torque and rotational speed at which motor 706 (e.g., motor 308) will operate. For example, if the pump is working against a high pressure, motor 706 may have to produce significant torque to overcome the pressure on the pump; similarly, motor 706 may have to operate at high speed in order to produce the desired flow rate of hydrocarbons out of the well at the specific pressure. A given torque and speed of motor 706 may be met by delivering a 3-phase electrical signal to the input terminals of motor 706 at a voltage and frequency. The same torque and speed requirements may be met by delivering the 3-phase electricity signal at several different voltage levels and frequencies. For example, input voltage can be increased by an amount to operate at a lower slip (i.e., motor slip as related to the rotational speed of the motor to the electrical frequency of the input signal) and lower frequency to maintain the same rotational speed, or input voltage can be decreased by an amount to operate at a higher slip and higher frequency and maintain the same rotational speed. It is noted that controlling the motor to a given speed is equivalent to controlling to a given mechanical power if the torque remains constant because two of the three values are required to define the third. Characteristics of cable 708 may influence the required voltage and frequency developed by drive 718 (e.g., drive 302) in order to induce the input voltage and input frequency at the terminal of motor 706. Drive 718 may refer to the controller (e.g., controller 222) that includes the drive or the drive itself depending on the context of the discussion. According to some embodiments, the voltage and frequency generated by drive 718 may be present on one side of cable 708; cable 708 may influence the signal, and a different voltage and frequency may be present at the input terminal of motor 706; this voltage and frequency may cause motor 706 to operate at a desired torque and speed to cause pump 704 to operate at a specified flow rate against the pressure necessary due to characteristics of well reservoir 702. In some embodiments, optimizer 720 is a system that is configured to determine a voltage and frequency, and transmits that voltage and frequency to the drive, in order to cause the motor to operate at a high efficiency.

According to some embodiments, to determine a voltage and frequency that causes the motor to operate at high efficiency, optimizer 720 requires knowledge of the motor speed and power usage. Data acquisition unit (DAQ) 710 may be configured to measure the 3-phase electrical signals present on the output of drive 718. In some embodiments, DAQ 710 may configured to estimate the speed of the motor and the power delivered by drive 718. In some embodiments, the measurements from the electrical signals may be transmitted to optimizer 720 and the motor speed and power usage may be estimated by optimizer 720. Estimating motor speed and power usage in optimizer 720 is particularly useful in embodiments where DAQ 710 is not configured to perform such estimations. Advantageously, estimating the speed of the motor using measurements from the electrical signals present at the output of drive 718 eliminates the need of using position and speed sensors in pumps (e.g., a submersible pump) where sensor disposition is more difficult. In some embodiments, DAQ 710 may be used to perform the calculations entailed by optimizer 720.

In some embodiments, Drive 718 includes phase calculator 716 to determine signals to send to pulse width modulator (PWM) 714. The signals received by PWM 714 determine the output signal that will be created on the output of drive 718. In some embodiments, cable drop compensator 712 may be configured to determine adjustments to the signal sent to PWM 714 to compensate for unsymmetric voltage drop within cable 708 or unsymmetric loading within motor 706. Cable drop compensator 712 may be configured to use the data collecting by DAQ 710 in order estimate the imbalance and to determine adjustments to the phase angle, magnitude, etc. of the signals sent to PWM 714 that will result in the resultant electrical currents to be balanced. The calculations performed by cable drop compensator may be performed by DAQ 710, drive 718 (or its controller; e.g., controller 222), or by any suitable hardware.

According to some embodiments, optimizer 720 is communicably connected to drive 718. Optimizer 720 may be configured to transmit voltage and frequency values to drive 718 in order to operate the motor at a high efficiency given the desired flow and pressure of the pumping system. According to some embodiments, optimizer 720 includes speed control 722 and voltage-frequency ratio adjuster 724. Optimizer 720 may be configured to receive a desired pump (or motor) speed. For example, optimizer 720 may receive a desired pump speed from pump optimizer 728, the control system managing hydrocarbon site 100 or well site 200, or from a user interface (e.g., remote terminal unit 46) where an operator is able to input the desired pump speed. Speed control 722 may be configured to adjust the frequency sent to drive 718 (e.g., using frequency adjuster 726) in order to cause the estimated motor speed received by speed control 722 to be affected towards and/or maintained at the desired pump speed. For example, frequency adjuster 726, may be configured to perform proportional-integral (PI) control or proportional-integral-derivative (PID) control. In some embodiments, other forms of control may be used to affect the motor speed (e.g., model predictive control (MPC), neural networks, etc.). Advantageously, optimizer 720 may be configured to adjust the voltage value sent to drive 718 to compensate for the change in frequency by multiplying a specified voltage-frequency ratio by the adjusted frequency, because the impedance of the motor may depend proportionally on the frequency of the of the input electricity adjusting the voltage for a specified voltage-frequency ratio may cause the speed of the motor to also vary more linearly with the adjustments to the frequency.

According to some embodiments, voltage-frequency ratio adjuster 724 is configured to adjust the operating voltage-frequency ratio towards a ratio that causes the motor to operate at high efficiency. The voltage-frequency ratio may then be multiplied by the current frequency specified by speed control 722. In some embodiments, the voltage may be adjusted independently from the frequency. However, it may be advantageous to perform optimization using the voltage-frequency ratio because it relates more linearly to the currents supplied to the motor and thus require smaller speed adjustments when the voltage-frequency ratio is adjusted rather than adjusting voltage independent from frequency. In some embodiments, voltage-frequency ratio adjuster 724 may be configured to make adjustments to the voltage-frequency ratio by monitoring the power usage received from DAQ 710 and adjust the voltage-frequency ratio in a direction to affect the power usage to decrease. As stated previously, during adjusting voltage-frequency ratio and monitoring the power, speed control 722 may be configured to maintain the motor speed at the desired speed by adjusting the frequency sent to drive 718. Voltage-frequency ratio adjuster 724 may be configured to adjust the voltage-frequency ratio at a speed slow enough that speed control 722 can maintain the desired speed or voltage-frequency ratio adjuster 724 may be configured monitor the speed and utilize power measurements after the speed has recovered to the desired speed.

In some embodiments, adjusting the voltage-frequency ratio and monitoring the power may follow an optimization procedure. In some embodiments, an extremum seeking control strategy may be used by voltage-frequency ratio adjuster 724 to continuously adjust the voltage-frequency ratio following a sinusoidal waveform; analyze the resulting power usage to determine an estimate of the gradient of the power with respect to the voltage-frequency ratio; and then adjust average of the sinusoidal waveform accordingly. In some embodiments, a golden section search optimization strategy may be used. Voltage-frequency ratio adjuster 724 may be configured to receive or determine a range of voltage-frequency ratios that may include the ratio at which minimum power is achieved and then systematically adjust the voltage-frequency ratio to values within that range eliminating regions of the range where the optimal value may no longer exist. In some embodiments, voltage-frequency ratio adjuster 724 may determine that the lowest power usage within the original range used is at the edge of the range and determine another (e.g., expanded) range to within which to adjust the voltage-frequency ratio that includes that boundary of the original range. In some embodiments, if the power does not change by a threshold or does for several iterations by a threshold, voltage-frequency ratio adjuster 724 may stop adjusting the voltage-frequency ratio. In some embodiments, voltage-frequency ratio adjuster 724 may begin adjusting the voltage-frequency ratio again after some criterion is satisfied. For example, voltage-frequency ratio adjuster 724 may begin adjusting the voltage-frequency ratio again after the power changes by a second threshold, after a new desired pump speed is received, or after a period of time.

In some embodiments, optimizer 720 may estimate savings. Optimizer 720 may periodically request that voltage-frequency ratio adjuster 724 causes the voltage to be adjusted to a standard voltage-frequency ratio and compare the power usage of the standard voltage-frequency ratio and the adjusted voltage-frequency ratio to estimate a savings for the current desired pump speed. Optimizer 720 may store the power usages at each of the voltage-frequency ratios during the standard adjustment process (e.g., during optimization) and perform a calculation using the amount by which the power changes to estimate the energy savings. In some embodiments, a baseline model of the electricity usage for a pump may be calculated. For example, the baseline model may be a regression model (e.g., linear or non-linear) that estimates the pump electrical power usage for various pressure and flows per operation prior to enabling the optimization. After optimization is enabled, the output of the regression model for the current operating point of the pump may be compared to the actual power usage to calculate a savings. In some embodiments, the energy savings may be multiplied by a coefficient to determine a source savings. For example, if the pump is operated using electricity from a grid or utility company that is using coal and/or natural gas to generate electricity, optimizer 720 may be configured to calculate the coal and/or natural gas savings from adjustments to the voltage-frequency ratio. In some embodiments, other savings indirectly used in the generation of the electricity (e.g., gasoline used by mining vehicles, water evaporated to cool the generation equipment, etc.) may also be calculated. In some embodiments, the watercut and/or the gas to oil ratio may be used to calculate the savings. In some embodiments, avoidance of secondary effects of the electricity generation (e.g., creation of carbon dioxide or other pollutant) may be calculated. In some embodiments, the savings may be calculated as a total energy saved, a total energy cost saved, or a savings (e.g., cost or energy) per unit of hydrocarbon extracted for a given timespan (e.g., a month, a quarter, a year, a lifetime of the asset).

In some embodiments, voltage-frequency ratio adjuster 724 may be configured to adjust the voltage-frequency ratio to drive the voltage-frequency ratio to an operating value that causes a positive effect other than (or in addition to) lower energy usage. For example, voltage-frequency ratio adjuster 724 may consider thermal stresses on the motor wearing the windings, vibrations, or any other factor that is affected by the voltage-frequency ratio during the adjustment process. Optimizer 720 can be integrated with various equipment at well site 200. For example, optimizer 700 can be integrated with DAQ 310 or drive 302 in some embodiments.

Figure 8:
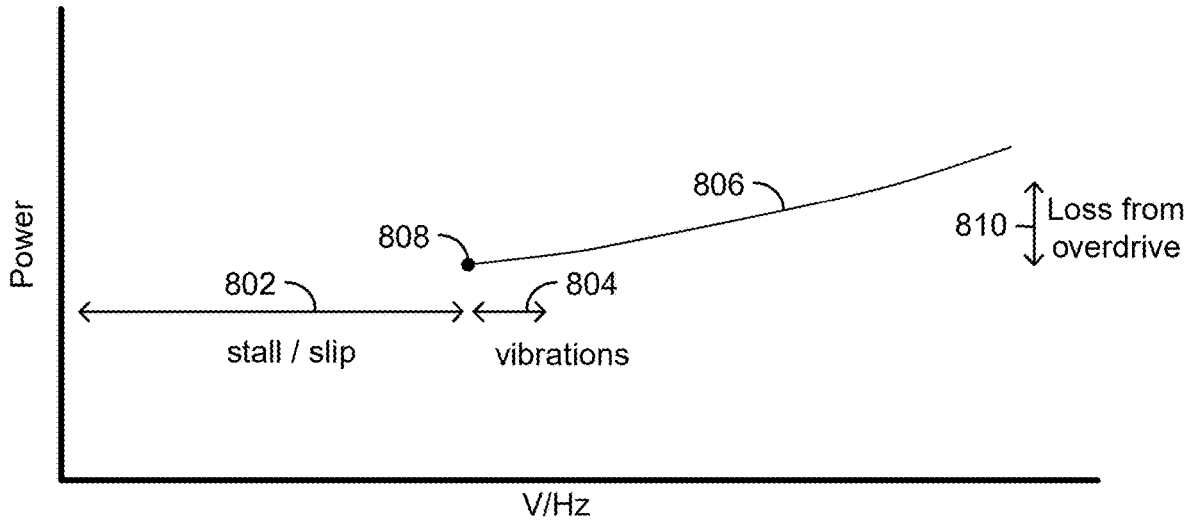
FIG. 8 is a plot showing power usage as a function of voltage-frequency ratio along with a number of regions of operation for a permanent magnet motor, according to some embodiments.

In some embodiments, systems and methods for optimizing a motor of a downhole pump will be used with permanent magnet motors (PMM). A PMM is different from an induction motor because it is a synchronous machine (i.e., the rotational speed of the motor can be calculated from the frequency of the driving electrical signal and the number of poles). In some embodiments controlling a drive attached to a PMM, speed control 722 is not required; instead, a frequency calculator may be used to convert the desired speed of the motor to a frequency (with units Hz) of the by dividing the current speed (with units of rotations per minute) by 120 and multiplying by the number of poles. Power usage as function of voltage-frequency ratio may also be different for PMMs. FIG. 8 shows power usage as a function of voltage-frequency ratio for a PMM in curve 806. Similar to induction motors, driving voltage-frequency ratio high may cause additional energy use for the same torque and speed requirements. As shown in FIG. 8 the voltage-frequency ratio of lowest power usage (point 808) may be the point just prior to a slip or stall condition of the PMM. Slip and or stall of a PMM (in regions of voltage-frequency ratio indicated by region 802) may cause an overcurrent leading to a drive shutdown. During normal operation, as the point of lowest power usage is approached oscillations in the speed or in the angle between the current vector and the magnetic flux vector of the motor may occur, indicating the potential for slip if the voltage is further reduced. In some embodiments, the occurrence of these oscillations or vibrations in voltage-frequency ratio region 804 may be used to adjust the voltage-frequency ratio to the effect of a minimal or near minimal power usage.

Figure 9:
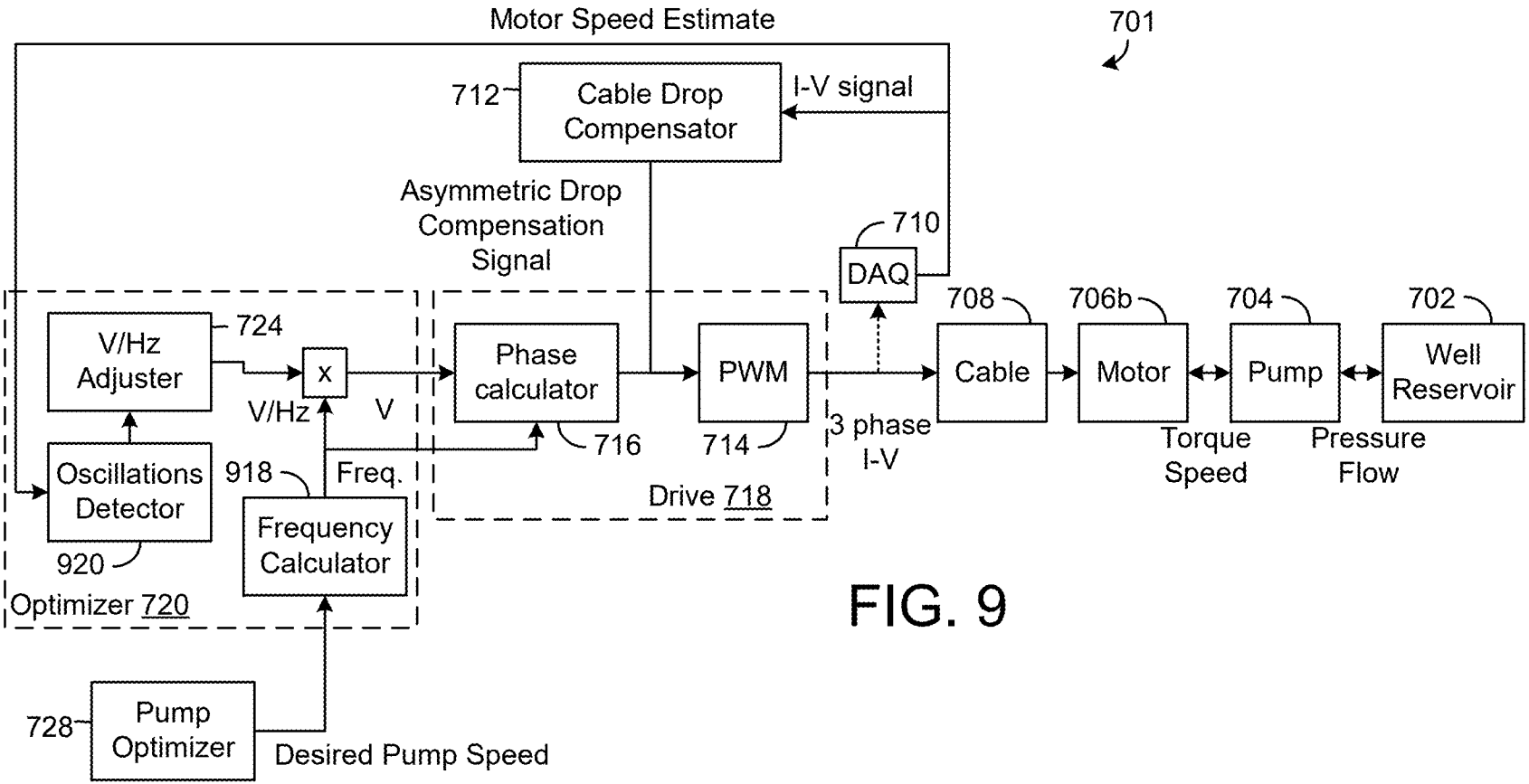
FIG. 9 is a signal flow diagram showing a strategy for optimizing the operating voltage and frequency of a motor, according to some embodiments.

FIG. 9 shows a signal flow diagram for a motor optimizer communicating with a drive connected to a PMM (e.g., motor 706*b*) according to some embodiments. The signal flow diagram in FIG. 9 is the same as FIG. 7 (which may be particularly useful for induction motors) with the exception of some of the components of optimizer 720 and the signals passed into optimizer 720; therefore, the discussion of how well reservoir 702, effects the operating point of pump 704, and the torque and speed requirements of motor 706*b* may apply to the case of a PMM. Likewise, the discussion of DAQ 710, cable drop compensator 712, and drive 718 may also apply. The strategy described by flow diagram 701 can be used to optimize any pumping system, but is particularly advantageous when sensor (e.g., rotor position sensors) disposition is difficult. The signal flow diagram can be performed by various equipment at well site 200 (e.g., DAQ 310 or drive 302) in some embodiments.

According to some embodiments, optimizer 720 includes frequency calculator 918, oscillations detector 920, and voltage-frequency ratio adjuster 724 as shown in FIG. 9. In some embodiments, frequency calculator 918 is configured to calculate the frequency to send to drive 718 using the equation, $$f[\mathrm{Hz}] = \frac{s[rpm] \cdot n}{120},$$

where n is the number of poles, and s is the speed in rotations per minute. In some embodiments, voltage-frequency ratio adjuster 724 is configured to adjust the operating voltage-frequency ratio towards a ratio that causes the motor to operate at high efficiency while maintaining stability (i.e., not causing excessive vibrations, slip, or stall of the PMM). The voltage-frequency ratio may then be multiplied by the current frequency calculated by frequency calculator 918. In some embodiments, the voltage may be adjusted independently from the frequency. In some embodiments, voltage-frequency ratio adjuster 724 may be configured to make adjustments to the voltage-frequency ratio based on detections from oscillations detector 920. For example, oscillations detector 920 may be configured to cause voltage-frequency ratio adjuster 724 to increase the voltage-frequency ratio if oscillations are detected and decrease the voltage-frequency ratio if oscillations are not detected.

Oscillations detector 920 may monitor the motor speed estimates or current and voltage measurements from DAQ 710 in order to detect oscillations. In some embodiments, DAQ 710 may estimate the speed of the motor or angle between the current vector and magnetic flux vector. In some embodiments, the measurements from the electrical signals may be transmitted to optimizer 720 and the motor speed, angle between the current vector and magnetic flux vector, and/or power usage may be estimated by optimizer 720. In some embodiments, the magnitude of any oscillations may be estimated either in the frequency domain by taking a Fourier transform of the signal that may includes the oscillations and looking for low frequency oscillations or the by estimating the magnitude in the time domain. To make a detection the estimated magnitude of the oscillations may be compared to a threshold. In some embodiments, the threshold may be calculated by periodically estimating the noise of the signal or data that may includes the oscillations (e.g., the motor speed estimate, the current and voltage measurements) and multiplying it by a margin; or the threshold may be constant. In some embodiments, oscillations detector 920 may receive a target oscillations magnitude (e.g., a constant stored in memory or from a calculation based on a noise estimate) and cause voltage-frequency ratio adjuster 724 to adjust the voltage-frequency ratio to affect the estimated oscillation magnitude towards that target. In some embodiments, oscillations detector 920 may perform a PI or PID control strategy in order to maintain the estimated oscillations at the target magnitude. In some embodiments, it may be possible to relate an average angle between the current vector and magnetic flux vector to an acceptable level of oscillations or stability. For example, the average angle could be saved when the oscillations are at an acceptable level or the angle of maximum torque generation could be estimated during the design of the motor to establish a threshold average angle. In some embodiments, the voltage may be increased if the average angle of between the current vector and the magnetic flux vector is above the threshold or decreased if the angle is below the threshold. In some embodiments, the magnitude of the oscillations may be estimated by the average angle between the current vector and magnetic flux vector.

In some embodiments, the energy savings realized (or any secondary and/or indirect savings) following the strategy described for operating a PMM motor at high efficiency may be estimated. The estimation may be performed using any of the techniques previously described.

Figure 10:
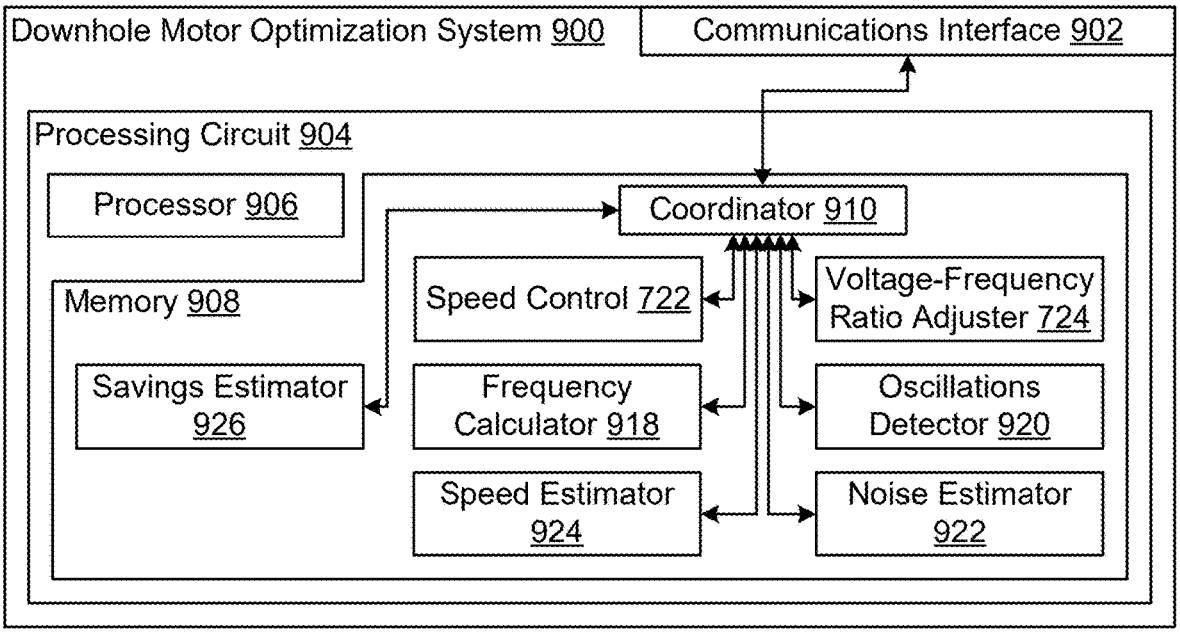
FIG. 10 is a system for implementing motor optimization strategies which can include the strategies shown in FIG. 7 and FIG. 9, according to some embodiments.

FIG. 10 shows downhole motor optimization system 900. Downhole motor optimization system 900 may be used to implement optimizer 720 as in the description related to flow diagram 700 (FIG. 7) or flow diagram 701 (FIG. 9). Downhole motor optimization system may include communications interface 902 in some embodiments. Communications interface 902 may be configured to receive and transmit signals communicating data to other systems within hydrocarbon site 100 and/or a cloud computer cluster. For example, communications interface 902 may be configured to communicate the desired frequency and voltage to the drive or drive controller. Communications interface 902 may be configured to receive a desired pump speed from pump optimizer 728 or a remote user interface on a locally networked computer or cloud computer cluster. Communications interface 902 may be configured to send a savings estimate to a user interface on a locally networked computer, or cloud computer cluster, or any suitable hardware. Communications interface 902 may be configured to store any of the data received in memory 908 for use by any of the modules in of downhole motor optimization system 900.

According to some embodiments, downhole motor optimization system 900 may include processing circuit 904 which includes and processor 906 and memory 908. In some embodiments, downhole motor optimization system 900 may include several processors and memory devices. The processors and memory devices may be distributed across several devices. For example, a number of the features of downhole motor optimization system 900 may be implemented by a DAQ unit, a number of features may be implemented by on the motor drive or its controller, a number of features may be implemented on locally networked computer or server hardware, and a number of features may be implemented in a cloud compute environment. The features may be distributed across any subset of the types of devices mentioned including within a single device.

According to some embodiments, memory 908 stores instructions to cause processor 906 to implement the features of downhole motor optimization system 900. Memory 908 may include coordinator 910, speed control 722, voltage-frequency ratio adjuster 724, savings estimator 926, frequency calculator 918, oscillations detector 920, speed estimator 924, and noise estimator 922. Coordinator 910 may be configured to coordinate or manage the operations of the other features of downhole motor optimization system 900. For example, coordinator 910 may be configured to manage the sequence in which the features run in order to perform optimization (e.g., optimizations as described by flow diagrams 700 and 701). According to some embodiments, speed control 722 may be configured to adjust the frequency being sent to the drive in order to maintain an estimated motor speed at a value specified. Speed control may perform its functions as described in the description referring to FIG. 7. According to some embodiments, speed estimator may estimate the speed of the motor using voltage and current measurements received by communications interface 902. Speed estimator 924 may be used when the DAQ unit used does not estimate the speed of the motor, to perform speed estimation using different techniques, or to estimate the uncertainty with the speed estimate. For example, speed estimator may use PMM stator equations in the αβ coordinate system, $$u_\alpha = R_S i_\alpha + L_S \frac{d}{dt} i_\alpha + \frac{d}{dt}\psi_\alpha, \text{ and}$$

$$u_\beta = R_S i_\beta + L_S \frac{d}{dt} i_\beta + \frac{d}{dt}\psi_\beta.$$

to estimate the speed of a PMM. u represents the voltage, i represents the current, $R_S$ represents the stator resistance, $L_S$ represents the stator resistance and ψ represents the flux linkage. In some embodiments, speed estimator 924 may calculate the instantaneous angle between the current vector and magnetic flux vector. According to some embodiments, voltage-frequency ratio adjuster 724 is configured to change the voltage-frequency ratio (and thus the voltage sent to the drive) in a systematic manner. voltage-frequency ratio adjuster 724 may be configured to perform an optimization routine as previously described or to respond to results of oscillations detector 920 dependent on the application of downhole motor optimization system 900. In some embodiments, speed estimate 924 may perform a steady state analysis to determine the average angle between the current vector and the magnetic flux vector.

According to some embodiments, frequency calculator 918 is configured to calculate the required frequency of the electrical input to a motor to cause a PMM to operate at the desired frequency. The calculations frequency calculator may use to calculate the required frequency have been described previously. According to some embodiments, noise estimator 922 may be configured to estimate the noise of a signal. Noise estimator 922 may be configured to estimate the noise of the signal carrying oscillations that are related to oscillations in the speed of the motor at voltages just above slip or stall voltages for a PMM (e.g., the electrical current and voltage measurements or the motor speed estimates). Noise estimator 922 may be configured to estimate noise in the frequency domain by looking the baseline signal power across all frequencies (e.g., for white noise) or across specific frequency bands (e.g., for other noise types). Noise estimator 922 may be configured to estimate noise in the time domain; for example, by calculating the error from a time varying mean of the signal and calculating the standard deviation of the error, wherein the time varying mean is calculated by averaging the samples from various windows of time. In some embodiments, the estimates from noise estimator 922 may be used to calculate a threshold that oscillations detector 920 can use to determine if the voltage-frequency ratio should be adjusted up or down. As discussed in the description related to FIG. 9 and flow diagram 701, in some embodiments, oscillations detector 920 may be configured to cause voltage-frequency ratio adjuster to move adjust the voltage frequency ratio in a direction to cause the motor to operate efficiently by monitoring the level of oscillations on the signal.

According to some embodiments, downhole motor optimization system 900 may include savings estimator 926. Savings estimator 926 may be configured to estimate the savings realized by using downhole motor optimization system 900. Savings estimator 926 may periodically request that voltage-frequency ratio adjuster 724 causes the voltage to be adjusted to a standard voltage-frequency ratio and compare the power usage of the standard voltage-frequency ratio and the adjusted voltage-frequency ratio to estimate a savings for the current desired pump speed. Savings estimator 926 may be configured to store the power usages at each of the voltage-frequency ratios during the standard adjustment process (e.g., during optimization) and perform a calculation using the amount by which the power changes to estimate the energy savings. In some embodiments, a baseline model of the electricity usage for a pump may be calculated. For example, the baseline model may be a regression model (e.g., linear or non-linear) that estimates the pump electrical power usage for various pressure and flows per operation prior to enabling the optimization. After optimization is enabled, the output of the regression model for the current operating point of the pump may be compared to the actual power usage to calculate a savings. In some embodiments, the energy savings may be multiplied by a coefficient to determine a source savings. For example, if the pump is run using electricity from a grid or utility company using coal and/or natural gas to generate electricity, savings estimator 926 may be configured to calculate the coal and/or natural gas savings from adjustments to the voltage-frequency ratio. In some embodiments, other savings indirectly used in the generation of the electricity (e.g., gasoline used by mining vehicles, water evaporated to cool the generation equipment, etc.) may also be calculated. In some embodiments, the watercut and/or the gas to oil ratio may be used to calculate the savings. In some embodiments, avoidance of secondary effects of the electricity generation (e.g., creation of carbon dioxide or other pollutant) may be calculated. In some embodiments, the savings may be calculated as a total energy saved, a total energy cost saved, or a savings (e.g., cost or energy) per unit of hydrocarbon extracted for a given timespan (e.g., a month, a quarter, a year, a lifetime of the asset).

Figure 12:
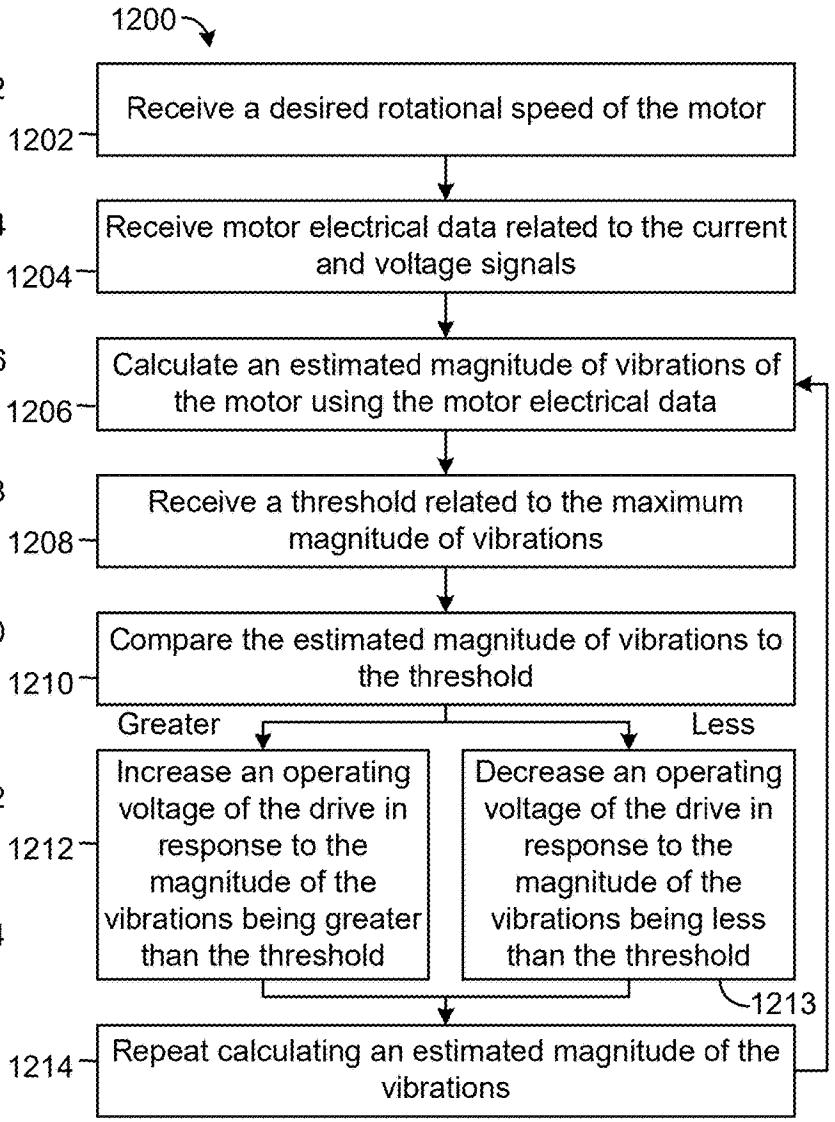
FIG. 12 is a flow diagram for a method for optimizing the operating voltage and frequency of a motor, according to some embodiments.
Figure 11:
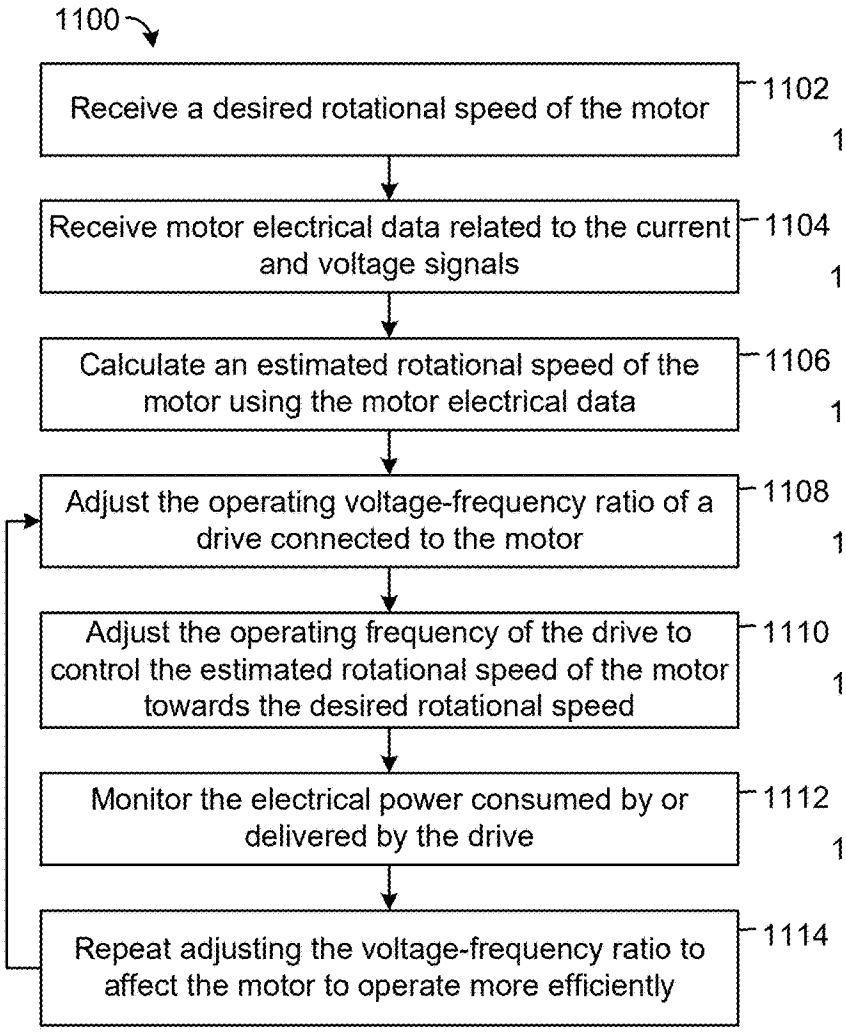
FIG. 11 is a flow diagram of a method for optimizing the operating voltage and frequency of a motor, according to some embodiments.
Figure 13:
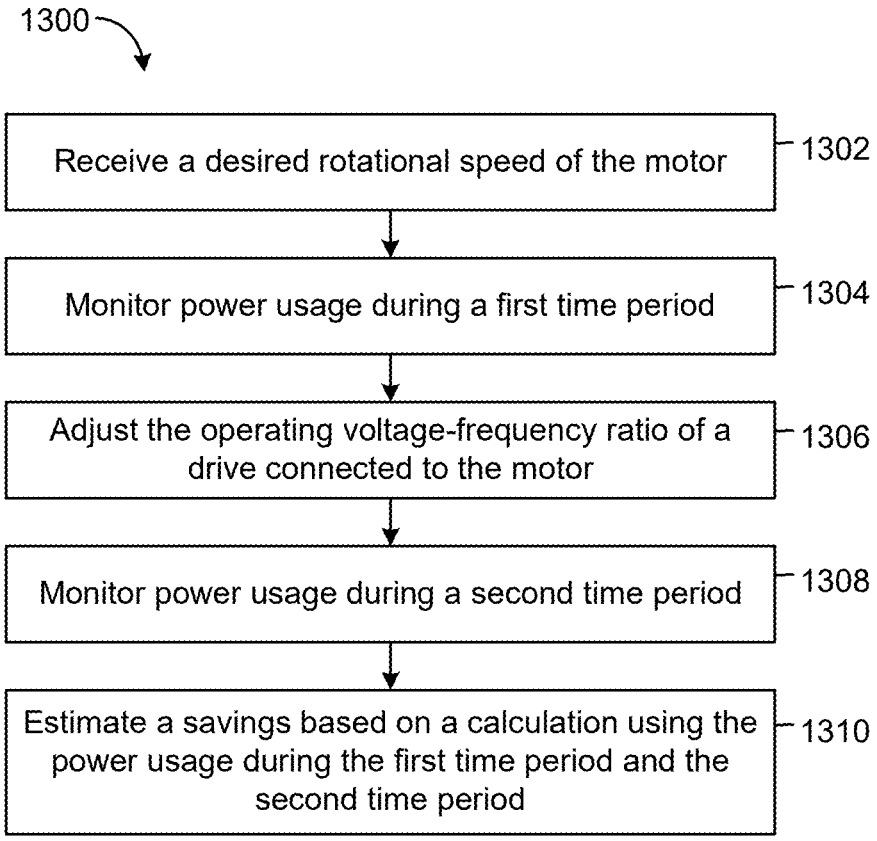
FIG. 13 is a flow diagram for a method for calculating savings incurred by performing an optimization strategy on a motor.

FIGS. 11-13 show methods for optimizing downhole motor operation and for estimating the savings realized by optimizing downhole motor operations according to some embodiments. The methods described herein could be executed using any number of memory devices with instructions stored to be executed by any number of processors. For example, the methods could be executed by a system such as downhole motor optimization system 900.

FIG. 11 shows a flow diagram for process 1100 a method for optimizing downhole motor according to some embodiments. In some embodiments, process 1100 begins with receiving a desired rotational speed of the motor. The desired rotational speed of the motor may received from a user interface or the desired rotational speed may be received from a site optimization system that is configured to determine the operating points of all pumps within a hydrocarbon site (e.g., hydrocarbon site 100). In some embodiments, process 1100 includes receiving motor electrical data related to the current and voltage signals in step 1104. Process 1100 may include a step for estimating the speed of the motor using the motor electrical data in step 1106. For example, a dynamic systems model of the motor relating the electrical signals to the rotational speed may be used to estimate the motor speed. In some embodiments, process 1100 includes adjusting the voltage-frequency ratio of a drive connected to the motor (e.g., as per any of the operations voltage-frequency ratio adjuster 724 is configured to perform). As previously discussed, adjusting the voltage-frequency ratio has the effect of adjusting the voltage; however, it may be advantageous to perform optimization using the voltage-frequency ratio for optimization because it will relate more linearly with the magnetization current. In some embodiments, process 1100 includes adjusting the operating frequency of the drive to control the estimated rotational speed of the motor towards the desired rotational speed in step 1110 (e.g., as per any of the operations speed control 722 is configured to perform). Slip of an induction motor may change when the operating voltage is changed, to maintain a constant speed it may be necessary to make adjustments to the frequency after the voltage-frequency ratio is updated. Adjusting the operating frequency of the drive may be performed by any suitable control strategy (e.g., PI, PID, etc.). According to some embodiments, process 1100 includes monitoring the electrical power consumed by the drive or delivered by the drive. Monitoring the electrical power may require suitable telemetry to the electrical signals provided to or from the drive. For example, a DAQ unit may be used in order to measure voltage and current of the drive and the power used or delivered may be calculated. It may be necessary, to monitor the electrical power for long enough for the power to reach a steady-state value. For example, after a change to the operating voltage-frequency ratio, it may be necessary to wait until adjustments to the frequency have been made and the speed has settled at the desired value before using the power estimates by an optimization routine. Process 1100, may include repeating the adjustments in step 1114 in order to drive affect the drive to operate the motor in a more efficient manner. In some embodiments, an extremum seeking control strategy may be to continuously adjust the voltage-frequency ratio following a sinusoidal waveform, and analyze the resulting power usage to determine an estimate of the gradient of the power with respect to the voltage-frequency ratio and then adjust average of the sinusoidal waveform accordingly. In some embodiments, a golden section search optimization strategy may be used. Step 1114 may include receiving or determining a range of voltage-frequency ratios that may include the ratio at which minimum power is achieved and then systematically adjust the voltage-frequency ratio to values within that range eliminating regions of the range where the optimal value may no longer exist.

FIG. 12 shows a flow diagram for process 1200 a method for optimizing downhole motor according to some embodiments. In some embodiments, process 1200 begins with receiving a desired rotational speed of the motor. The desired rotational speed of the motor may received from a user interface or the desired rotational speed may be received from a site optimization system that is configured to determine the operating points of all pumps within a hydrocarbon site (e.g., hydrocarbon site 100). In some embodiments, process 1200 includes receiving motor electrical data related to the current and voltage signals in step 1204. In some embodiments, the desired rotational speed is used to calculate an operating frequency of the motor. In some embodiments, process 1200 includes calculating an estimated magnitude of vibrations of the motor using the motor electrical data in step 1206 (e.g., as per any of the operations oscillations detector 920 is configured to perform). Estimating the magnitude of the vibrations may be performed using the voltage and current measurements at the output of the drive, performed using the estimated speed of the motor, or performed using the estimated angle between the current vector and the magnetic flux vector. For example, the speed may be estimated using the PMM stator equations described above.

In some embodiments, process 1200 includes receiving a threshold related to the maximum magnitude of vibrations in step 1208. The threshold may be received from a user interface (e.g., directly entered by a user) or the threshold may be received by performing calculations. For example, statistical calculations could be performed to estimate the random fluctuations of the signal, calculation, or measurement from which the magnitude of the vibrations are estimated. In some embodiments, the calculations performed by noise estimator 922 may be used to determine a threshold. Process 1200 may include comparing the magnitude of the vibrations to the threshold in step 1210. The determination of this comparison may direct the process to continue to increase the operating voltage of the drive if the magnitude of the vibrations is greater than the threshold in step 1212 or decrease the operating voltage of the drive if the magnitude of the vibrations is less than the threshold in step 1213. Process 1200 may include repeating steps 1206-1214 to maintain the magnitude of the vibrations at a minimal amount (e.g., at the noise level or at a specified level). Advantageously, minimizing the vibrations, but keeping the voltage just at the level vibrations or oscillations in the speed of the motor start may keep power usage low (i.e., keep the motor operating at a high efficiency) while also minimizing the wear on the motor. In some embodiments, the threshold level of the magnitude of the vibrations may be determined by performing an optimization that includes a tradeoff between the wear of the motor from vibrations and the energy savings from operating near the slip or stall region where the oscillations of the motor speed occur. While this process can be used for motors in various situations, it is particularly advantageous for motors driving downhole pumps where sensor disposition is more difficult.

FIG. 13 shows a flow diagram for process 1300 a method for estimating the savings realized by performing an optimization of a motor according to some embodiments. In some embodiments, process 1300 uses some of the operations savings estimator 926 is configured to perform. According to some embodiments, process 1300 includes receiving a desired rotational speed of the motor in step 1302. Receiving the desired rotational speed of the motor may, for example, be used to indicate that a new operating point has been chosen and a new savings calculations should begin, or it may be used to determine a standard voltage-frequency ratio for that operating range. In some embodiments, process 1300 includes monitoring the power usage during a first period of time in step 1304. After receiving the desired rotational speed, it may take some time for the motor to reach the new speed. The first time period, for example, may be the time period after the speed reaches the new speed; or in another example, the some adjustments to the voltage-frequency ratio may be made (e.g., to a standard ratio for the new operating point, etc) and the speed settles at the new speed before the first time period begins. In some embodiments, process 1300 includes making adjustments to the voltage-frequency ratio (e.g., following any of the optimization procedures discussed herein) of the drive connected to the motor in step 1306. Process 1308 may include monitoring the power usage during a second time period in step 1308. In some embodiments, the second time period may be a time period after the adjustments following an optimization procedure are performed.

In some embodiments, process 1300 includes estimating the savings based on a calculation using the power usage during the first time period and the second time period. In some embodiments, the voltage-frequency ratio may be adjusted to a standard voltage-frequency ratio and the power usage of the standard voltage-frequency ratio and the adjusted voltage-frequency ratio may be compared to estimate a savings for the current desired pump speed. In some embodiments, power usages at each of the voltage-frequency ratios during the standard adjustment process (e.g., during optimization) may be stored and used to perform a calculation using the amount by which the power changes to estimate the energy savings.

Configuration of Exemplary Embodiments

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (i.e., permanent or fixed) or moveable (i.e., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (i.e., directly coupled), the generic definition of "coupled" provided above is modified by the plain language meaning of the additional term (i.e., "directly coupled" means the joining of two members without any separate intervening member), resulting in a narrower definition than the generic definition of "coupled" provided above. Such coupling may be mechanical, electrical, or fluidic.

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (i.e., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure.

It is important to note that the construction and arrangement of the apparatus as shown in the various exemplary embodiments is illustrative only. Additionally, any element disclosed in one embodiment may be incorporated or utilized with any other embodiment disclosed herein. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A system for efficiently running a pump driven by a motor, the system comprising:

one or more memory devices having instructions stored thereon that, when executed by one or more processors, cause the one or more processors to perform operations comprising:

receiving a desired operating rotational speed of the motor;

receiving motor electrical data related to current signals and voltage signals of a drive connected to the motor;

calculating an estimated rotational speed of the motor using the motor electrical data;

adjusting an operating voltage of the drive connected to the motor to obtain an adjusted operating voltage;

adjusting an operating frequency of the drive to control the estimated rotational speed of the motor to the desired operating rotational speed in response to changes to the estimated rotational speed from adjustments to the operating voltage;

monitoring an electrical power consumed by the drive resulting from the adjusted operating voltage and adjusting the operating frequency; and performing additional adjustments to the operating voltage and the operating frequency in a systematic manner to affect the motor to operate at a higher efficiency while controlling the estimated rotational speed of the motor to the desired operating rotational speed, wherein performing the additional adjustments comprises adjusting a combined value equal to an uncompensated voltage divided by a current operating frequency using a gradient descent procedure, an extremum seeking control procedure, or a golden section search procedure and determining the adjusted operating voltage by multiplying the combined value by the current operating frequency.

2. The system of claim 1, wherein adjusting the operating frequency is performed by a proportional-integral controller.

3. The system of claim 1, the operations further comprising estimating a cable voltage drop to obtain an estimated cable voltage drop, wherein the adjusted operating voltage is calculated by adding the estimated cable voltage drop to the uncompensated voltage.

4. The system of claim 3, the operations further comprising calculating an asymmetric voltage to compensate for asymmetries in the cable voltage drop as the operating frequency and operating voltages are adjusted.

5. The system of claim 1, wherein determining the desired operating rotational speed of the pump comprises performing an optimization using an objective function comprising at least one of pump efficiency or pump vibration.

6. The system of claim 1, wherein the desired operating rotational speed is based on a desired pressure and flow of the pump.

7. A method for efficiently running a pump driven by a motor, the method comprising:

receiving a desired operating rotational speed of the motor;

receiving motor electrical data related to current signals and voltage signals of a drive connected to the motor;

calculating an estimated rotational speed of the motor using the motor electrical data;

adjusting an operating voltage of the drive connected to the motor to obtain an adjusted operating voltage;

adjusting an operating frequency of the drive to control the estimated rotational speed of the motor to the desired operating rotational speed in response to changes to the estimated rotational speed from adjustments to the operating voltage;

monitoring an electrical power consumed by the drive resulting from the adjusted operating voltage and adjusting the operating frequency; and performing additional adjustments to the operating voltage and the operating frequency in a systematic manner to affect the motor to operate at a higher efficiency while controlling the estimated rotational speed of the motor to the desired operating rotational speed, wherein performing the additional adjustments comprises adjusting a combined value equal to an uncompensated voltage divided by a current operating frequency using a gradient descent procedure, an extremum seeking control procedure, or a golden section search procedure and determining the adjusted operating voltage by multiplying the combined value by the current operating frequency.

8. The method of claim 7, wherein adjusting the operating frequency is performed by a proportional-integral controller.

9. The method of claim 7, the method further comprising estimating a cable voltage drop to obtain an estimated cable voltage drop, wherein the adjusted operating voltage is calculated by adding the estimated cable voltage drop to the uncompensated voltage.

10. The method of claim 9, the method further comprising calculating an asymmetric voltage to compensate for asymmetries in the cable voltage drop as the operating frequency and operating voltages are adjusted.

11. The method of claim 7, wherein determining the desired operating rotational speed of the pump comprises performing an optimization using an objective function comprising at least one of pump efficiency or pump vibration.

12. The method of claim 7, wherein the desired operating rotational speed is based on a desired pressure and flow of the pump.

13. The system of claim 1, wherein the desired operating rotational speed of the motor is received from a hydrocarbon site optimization system.

14. One or more non-transitory computer-readable media storing instructions thereon that, when executed by one or more processors, cause the one or more processors to:

receive a desired operating rotational speed of a motor for a pump;

receive motor electrical data related to current signals and voltage signals of a drive connected to the motor;

calculate an estimated rotational speed of the motor using the motor electrical data;

adjust an operating voltage of the drive connected to the motor to obtain an adjusted operating voltage;

adjust an operating frequency of the drive to control the estimated rotational speed of the motor to the desired operating rotational speed in response to changes to the estimated rotational speed from adjustments to the operating voltage;

monitor an electrical power consumed by the drive resulting from the adjusted operating voltage and adjusting the operating frequency; and perform additional adjustments to the operating voltage and the operating frequency in a systematic manner to affect the motor to operate at a higher efficiency while controlling the estimated rotational speed of the motor to the desired operating rotational speed, wherein performing the additional adjustments comprises adjusting a combined value equal to an uncompensated voltage divided by a current operating frequency using a gradient descent procedure, an extremum seeking control procedure, or a golden section search procedure and determining the adjusted operating voltage by multiplying the combined value by the current operating frequency.

15. The one or more non-transitory computer-readable media of claim 14, wherein adjusting the operating frequency is performed by a proportional-integral controller.

16. The one or more non-transitory computer-readable media of claim 14, the instructions further causing the one or more processors to estimate a cable voltage drop to obtain an estimated cable voltage drop, wherein the adjusted operating voltage is calculated by adding the estimated cable voltage drop to the uncompensated voltage.

17. The one or more non-transitory computer-readable media of claim 16, the instructions further causing the one or more processors to calculate an asymmetric voltage to compensate for asymmetries in the cable voltage drop as the operating frequency and operating voltages are adjusted.

18. The one or more non-transitory computer-readable media of claim 14, wherein determining the desired operating rotational speed of the pump comprises performing an optimization using an objective function comprising at least one of pump efficiency or pump vibration.

19. The one or more non-transitory computer-readable media of claim 14, wherein the desired operating rotational speed is based on a desired pressure and flow of the pump.

20. The one or more non-transitory computer-readable media of claim 14, wherein the desired operating rotational speed of the motor is received from a hydrocarbon site optimization system.

* * * * *